US009022528B2

(12) United States Patent
Watanabe et al.

(10) Patent No.: US 9,022,528 B2
(45) Date of Patent: May 5, 2015

(54) LIQUID EJECTING HEAD AND LIQUID EJECTING APPARATUS

(71) Applicant: Seiko Epson Corporation, Tokyo (JP)

(72) Inventors: Shunsuke Watanabe, Matsumoto (JP); Katsumi Enomoto, Koza-gun (JP); Yasuo Inaoka, Shiojiri (JP); Ryota Kinoshita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/457,641

(22) Filed: Aug. 12, 2014

(65) Prior Publication Data

US 2015/0054887 A1 Feb. 26, 2015

(30) Foreign Application Priority Data

Aug. 20, 2013 (JP) ..... 2013-170802

(51) Int. Cl.
*B41J 2/14* (2006.01)

(52) U.S. Cl.
CPC .... *B41J 2/14201* (2013.01); *B41J 2002/14491* (2013.01)

(58) Field of Classification Search
CPC .. B41J 2/1623; B41J 2/14274; B41J 2202/19; B41J 2002/14491; B41J 2002/14306; B41J 2202/18
USPC ..... 347/20, 54, 56–58, 68
See application file for complete search history.

(56) References Cited

U.S. PATENT DOCUMENTS

| | | | | |
|---|---|---|---|---|
| 8,371,679 | B2 * | 2/2013 | Miyata et al. | 347/50 |
| 8,523,326 | B2 * | 9/2013 | Enomoto et al. | 347/50 |
| 8,757,782 | B2 * | 6/2014 | Watanabe et al. | 347/84 |
| 8,801,154 | B2 * | 8/2014 | Watanabe et al. | 347/71 |
| 2010/0091071 | A1 | 4/2010 | Owaki | |
| 2011/0316943 | A1 | 12/2011 | Owaki et al. | |

FOREIGN PATENT DOCUMENTS

JP 2010-115918 5/2010

OTHER PUBLICATIONS

European Search Report for Application No. 14181629.8 dated Nov. 20, 2014.

* cited by examiner

*Primary Examiner* — An Do
(74) *Attorney, Agent, or Firm* — Workman Nydegger

(57) ABSTRACT

A liquid ejecting head includes a head chip that ejects ink from a liquid ejecting surface. An inlet is disposed on the side opposite to the liquid ejecting surface. The liquid ejecting head includes an upstream flow path member, a downstream flow path member with an accommodating space that accommodates the head chip, a wiring member that is connected to a piezoelectric actuator in the head chip, and a wiring substrate. A first insertion hole, into which the wiring member is inserted, is disposed in the wiring substrate, a second insertion hole that is open to the accommodating space and the wiring substrate side for the wiring member to be inserted is formed in the downstream flow path member, and the wiring member is inserted into the first insertion hole and the second insertion hole to be bonded to the upstream flow path member side of the wiring substrate.

20 Claims, 14 Drawing Sheets

LIQUID EJECTING HEAD AND LIQUID EJECTING APPARATUS

CROSS REFERENCE TO RELATED APPLICATIONS

The present application claims priority to Japanese Patent Application No. 2013-170802 filed on Aug. 20, 2013 which is hereby incorporated by reference in its entirety.

BACKGROUND

1. Technical Field

Embodiments of the present invention relate to a liquid ejecting head that ejects a liquid from a nozzle, and a liquid ejecting apparatus. More particularly, embodiments relate to an ink jet type recording head that discharges a liquid such as ink, and an ink jet type recording apparatus.

2. Related Art

Representative examples of liquid ejecting heads that discharge a liquid include ink jet type recording heads that discharge ink droplets. Proposed as an example of the ink jet type recording heads is an ink jet type recording head that includes a head chip. The head chip has a flow path forming substrate where a pressure generating chamber communicating with a nozzle is formed. The ink jet type recording head may also include a case member where a wiring substrate that is connected to a pressure generating unit which is disposed in the head chip is held. The wiring substrate and the pressure generating unit of the head chip are interconnected via a wiring member such as a COF. For example, refer to JP-A-2010-115918.

The wiring substrate according to JP-A-2010-115918 is arranged to be vertical to a liquid ejecting surface (surface of a nozzle plate where the nozzle is disposed), and the wiring member is connected to the wiring substrate.

However, during the assembly of the ink jet type recording head, a state where the wiring substrate is vertical to a liquid ejecting surface has to be maintained. The wiring member has to be fixed while being held in place without being shifted downward in a state where the wiring member is aligned at a predetermined position of the wiring substrate. When the wiring substrate and the wiring member are fixed to the surface which is vertical to the liquid ejecting surface in this manner, a fixing operation has to be performed while maintaining a state where the wiring substrate and the wiring member are set to a predetermined position or direction. This increases the complexity of an assembly operation.

It is also difficult to perform various operations such as fixing and positioning in a state where the posture is maintained for the components of the ink jet type recording head other than the wiring substrate described above. As such, it would be useful if the assembly were enabled through a very simple operation.

These disadvantages are not limited to the ink jet type recording head, and are present in a similar manner in liquid ejecting heads that eject other liquids.

SUMMARY

An advantage of some embodiments of the invention is to provide a liquid ejecting head and a liquid ejecting apparatus that can be assembled at a reduced cost.

According to one embodiment of the invention, a liquid ejecting head may include a head chip that ejects a liquid from a liquid ejecting surface. A liquid connection is disposed on the side opposite to the liquid ejecting surface in the head chip so that the supply and discharge of the liquid is performed. The liquid ejecting head may also include a first flow path member where a first flow path for the liquid is disposed, a second flow path member that is bonded to the first flow path member, where an accommodating space that is open to the side opposite to the first flow path member and accommodates the head chip and a second flow path for the liquid that is open into the accommodating space and is connected to the first flow path are disposed, a wiring member that is connected to a pressure generating unit which generates pressure change in a flow path in the head chip, and a wiring substrate that is arranged between the first flow path member and the second flow path member. The head chip is accommodated in the accommodating space and the liquid connection is connected to the second flow path. A first insertion hole, into which the wiring member is inserted, is disposed in the wiring substrate and a second insertion hole that is open to the accommodating space and the wiring substrate side for the wiring member to be inserted is formed in the second flow path member. The wiring member is inserted into the first insertion hole and the second insertion hole in order to be bonded to the first flow path member side of the wiring substrate.

In one embodiment, the connection between the wiring member and the wiring substrate can be performed with ease from the first flow path member side, and assemblability can be improved. In other words, the assembly of the liquid ejecting head can be facilitated and the wiring member and the wiring substrate can be connected with ease when the head chip is fixed to the second flow path member and the wiring member is inserted into the second insertion hole while the second flow path member is moved to the head chip side from above (first flow path member side in the stacking direction of each component), the wiring member is inserted into the first insertion hole of the wiring substrate, and then an end portion of the wiring member inserted into the first insertion hole and the second insertion hole is connected to the wiring substrate. In this manner, the wiring substrate can be assembled with the second flow path member from the stacking direction, and thus the structure can be made particularly suitable for machine-based automatic assembly. As such, the costs associated with the assembly can be significantly reduced.

Herein, the liquid ejecting head may further include a seal member that is arranged between the wiring substrate and the first flow path member to connect the first flow path and the second flow path. A protrusion that protrudes to the second flow path member side and a communicating path that is open to a surface of the protrusion facing the second flow path member to penetrate in the direction intersecting with the liquid ejecting surface are disposed in the seal member. A through-hole, into which the protrusion of the seal member is inserted, is disposed in the wiring substrate. The first flow path and the second flow path communicate with each other via the communicating path that is formed in the protrusion which is inserted into the through-hole. In this case, the through-hole guides the seal member to be arranged at a predetermined position as the protrusion is inserted into the through-hole. Thus the seal member can be positioned in and fixed to the second flow path member with ease.

In addition, pressure may be applied to at least the protrusion of the seal member by the first flow path member and the second flow path member in a stacking direction in which the first flow path member and the second flow path member are bonded. The protrusion that is formed in the seal member communicates with the communicating path in a sealed state due to the pressure. In this case, the structure of the seal member can allow assembly with the first flow path member and the second flow path member through only the movement in the stacking direction or the application of the pressure in actuality. In addition, since the accommodating space is formed in the first flow path member, the generation of stress due to the pressure applied in the stacking direction and acting on the head chip can be suppressed. In this manner, the generation of stress in the head chip can be suppressed, and the operation for assembling the seal member can be facilitated.

In addition, the liquid ejecting head may further include a fixing member to which the head chip is fixed and which is fixed to the second flow path member. In this case, a plurality of the head chips can be accommodated in and fixed to the accommodating space at the same time.

In addition, the liquid connection of the head chip may protrude more than any other site of the head chip to the second flow path member side. In this case, the liquid connection is positioned more on the second flow path member side than any other site in the head chip, and no part protrudes more to the second flow path member side than the liquid connection. In other words, a site inhibiting the contact between the liquid connection and the accommodating space may not be present in the head chip. Accordingly, the operation for connecting the liquid connection to the second flow path and for fixing the head chip to the second flow path member can be performed with ease.

In addition, the liquid connection and an opening of the second flow path may be bonded with an adhesive. In this case, the adhesive covers the difference between the depth of the accommodating space and the height of the head chip even when the depth of the accommodating space and the height of the head chip do not exactly match each other. Thus the liquid connection of the head chip can communicate, without a gap, with the second flow path that is open to the accommodating space.

In addition, a reference mark may be formed in the fixing member and the second flow path member so as to define relative positions of the fixing member and the second flow path member. In this case, the fixing member and the second flow path member can be arranged at predetermined relative positions with ease since a first reference mark and a second reference mark are disposed.

In addition, a caulking pin may be formed on the wiring substrate side of the second flow path member. The wiring substrate is fixed to the second flow path member as the caulking pin is caulked. In this case, the wiring substrate can be positioned in and fixed to the second flow path member with ease by caulking the caulking pin.

In addition, the seal member may include a plate-shaped base portion where the protrusion and the communicating path are disposed. A wall that protrudes from the base portion to the first flow path member side may be formed to have an annular shape. The first flow path member may be in contact with at least an outer side of the wall. In this case, the inclination and collapse of the wall of the seal member are regulated. Thus the generation of a gap between the wall and the first flow path member can be suppressed, and the wall can remain airtight inside.

In addition, a groove, into which the wall is inserted, may be formed on a surface of the first flow path member facing the seal member, and an opening of the groove into which the wall is inserted is chamfered. In this case, the operation for inserting the wall into the groove can be performed with ease.

In addition, a fixing pin may be formed in any one of the first flow path member and the second flow path member to protrude to the other side, in which a fixing hole, which has an inner surface in contact with a side surface of the fixing pin, is disposed in the other one of the first flow path member and the second flow path member. The fixing hole is formed so that an opening on the side where the fixing pin is inserted is larger in outer diameter than the fixing pin. In this case, a rough yet rapid positioning of the first flow path member with respect to the second flow path member can be performed by inserting the fixing pin into the opening of the fixing hole on the fixing pin side. By inserting the fixing pin into the fixing hole, the first flow path member and the second flow path member can be positioned and fixed.

Further, according to one embodiment of the invention, a liquid ejecting apparatus including the liquid ejecting head according to the embodiments described above is provided. Assembly costs of the liquid ejecting apparatus can be reduced.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, embodiments of the invention will be described in detail. An ink jet type recording head is an example of a liquid ejecting head, and may be referred to as a recording head.

Figure 1:
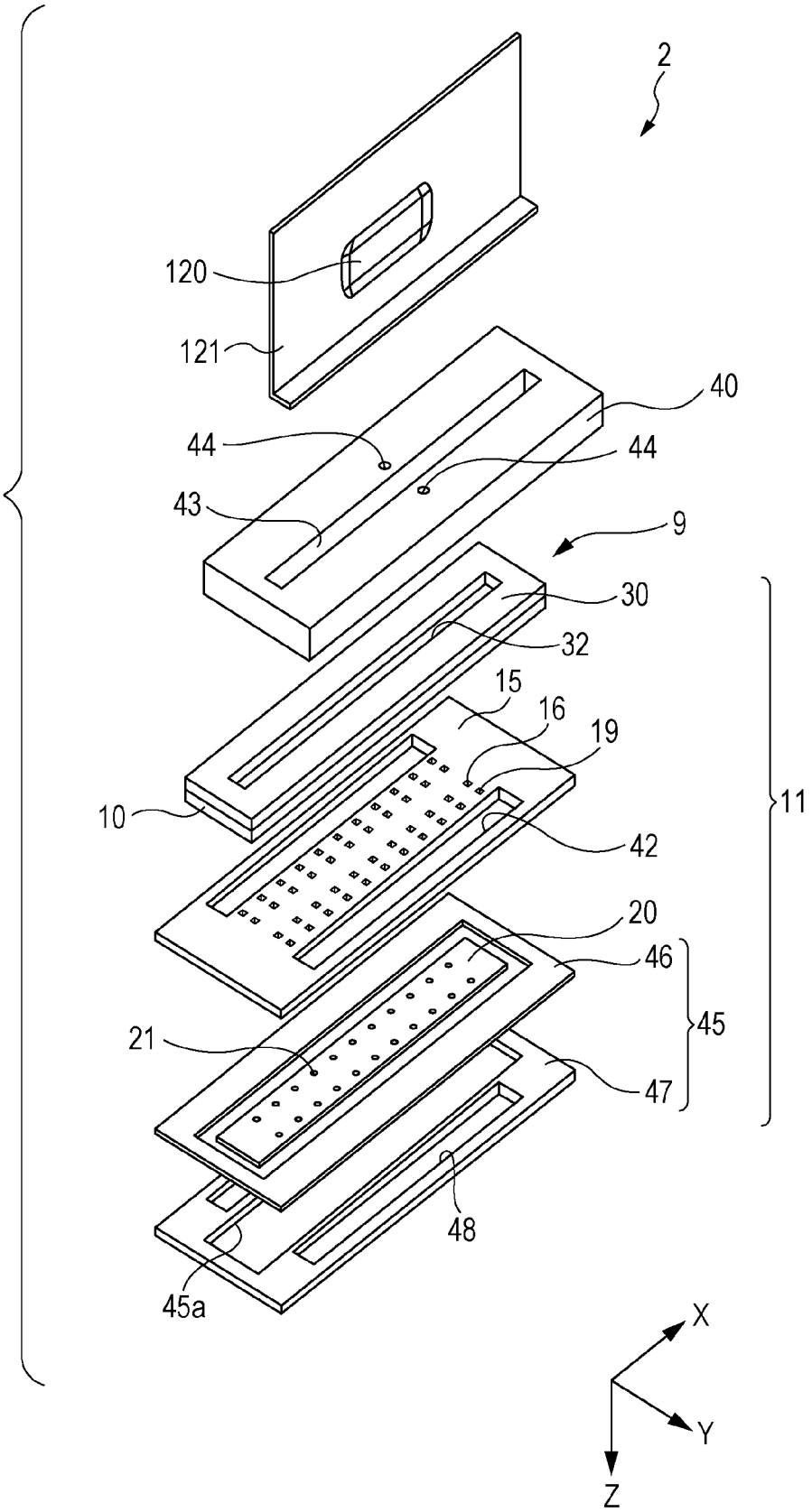
FIG. 1 is an exploded perspective view of an example of a head chip.
Figure 2:
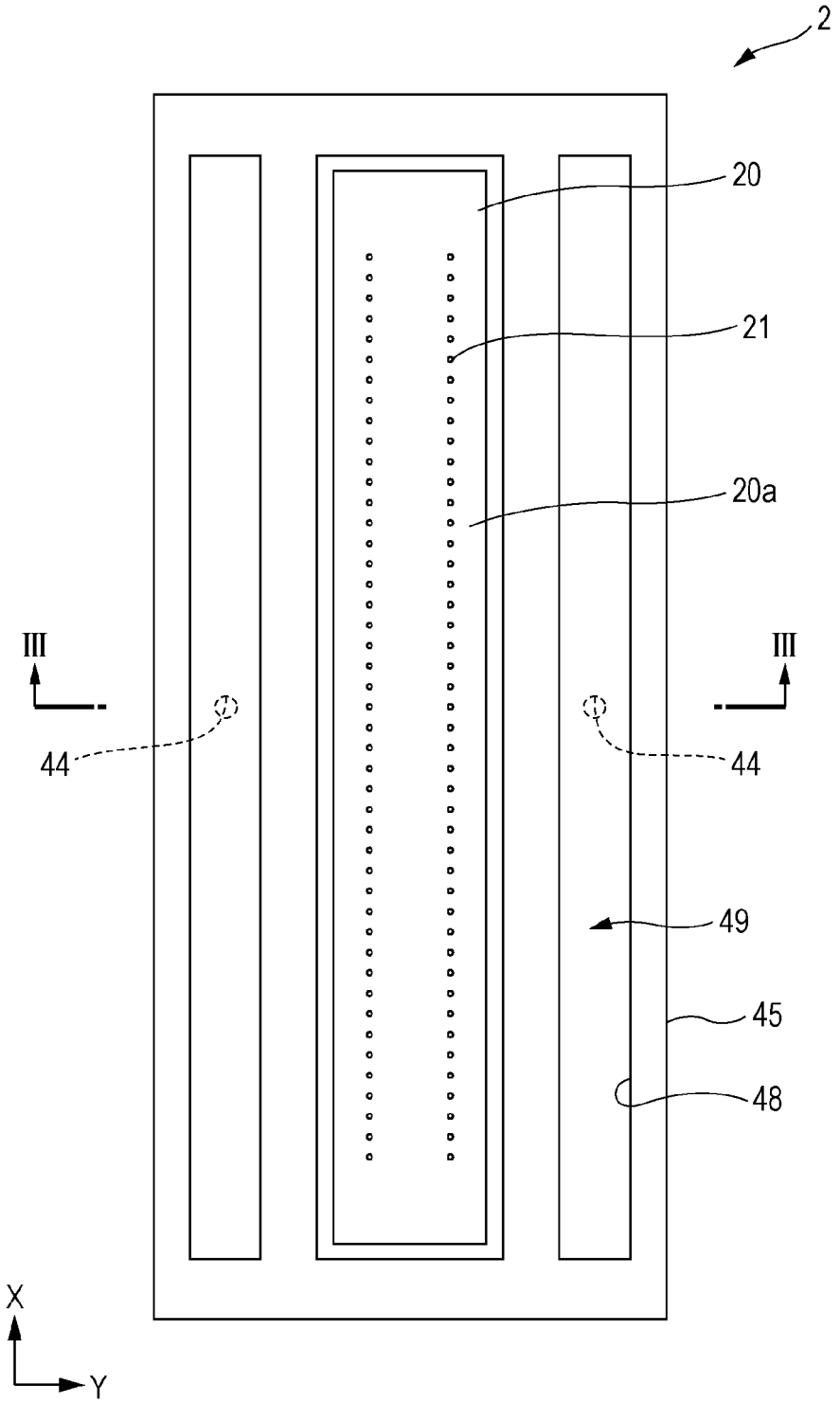
FIG. 2 is a plan view of the head chip.
Figure 3:
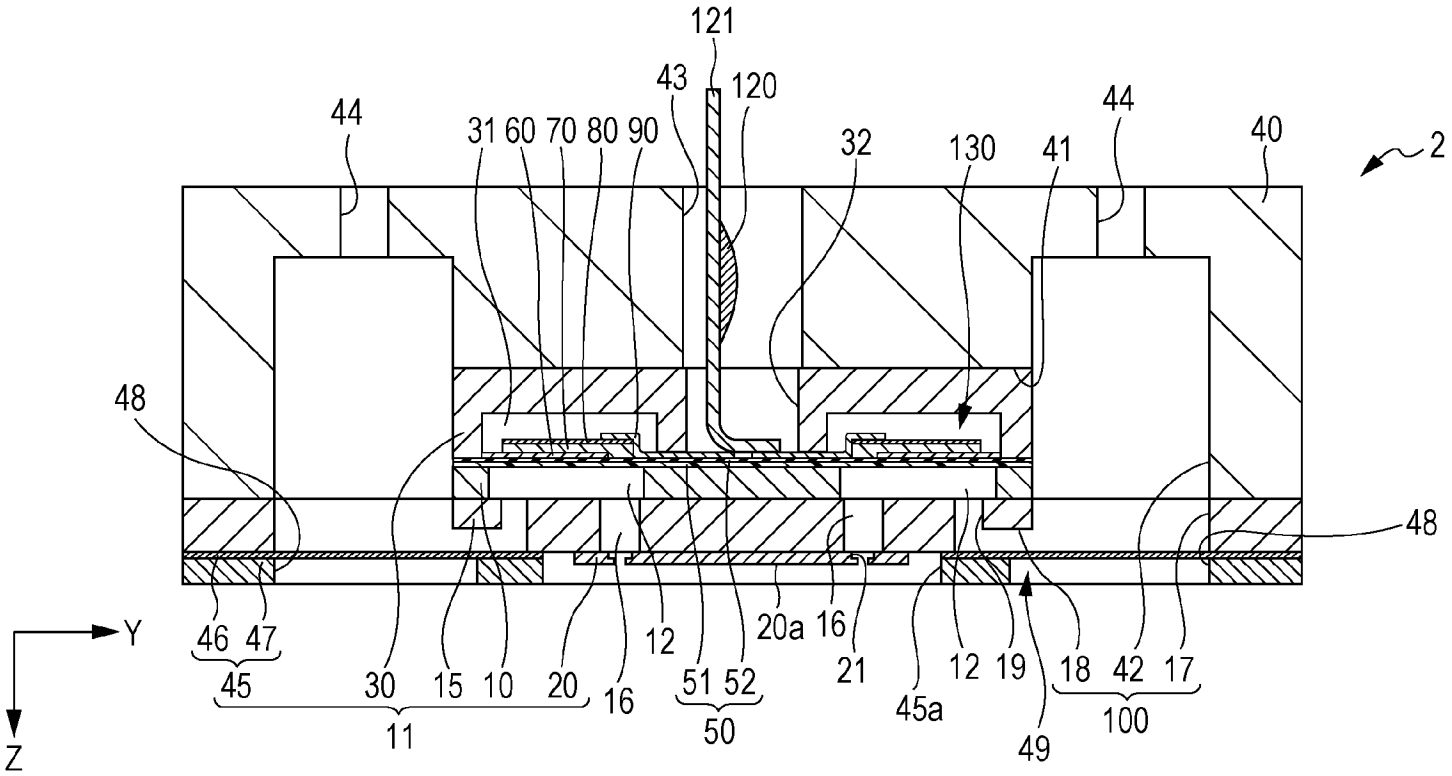
FIG. 3 is a sectional view of the head chip.

Firstly, an example of a head chip that is disposed in the recording head will be described. FIG. 1 is an exploded perspective view of an example of a head chip. FIG. 2 is a plan view of the head chip. FIG. 3 is a sectional view of the head chip.

As illustrated in the drawings, a head chip 2 may include a plurality of members such as a head main body 11 and a case member 40 that is fixed to the head main body 11 on one surface side. In addition, the head main body 11 includes a flow path forming substrate 10, a communicating plate 15 that is disposed on one surface side of the flow path forming substrate 10, a nozzle plate 20 that is disposed on the surface side of the communicating plate 15 opposite to the flow path forming substrate 10, a protective substrate 30 that is disposed on the side of the flow path forming substrate 10 opposite to the communicating plate 15, and a compliance substrate 45 that is disposed on the surface side of the communicating plate 15 where the nozzle plate 20 is disposed.

A metal such as stainless steel and Ni, a ceramic material typified by $ZrO_2$ or $Al_2O_3$, an oxide such as a glass ceramic material, MgO, and $LaAlO_3$, and the like can be used in the flow path forming substrate 10 that is included in the head main body 11. In one embodiment, the flow path forming substrate 10 may be formed of a silicon single crystal substrate. A plurality of pressure generating chambers 12 that are partitioned by a partition wall are juxtaposed on the flow path forming substrate 10, through anisotropic etching from the one surface side, in a direction in which a plurality of nozzles 21 discharging ink are juxtaposed.

Hereinafter, this direction is referred to as a direction of juxtaposition of the pressure generating chambers 12, or a first direction X. In addition, a plurality of rows in which the pressure generating chambers 12 are juxtaposed in the first direction X, two rows in one embodiment, are disposed on the flow path forming substrate 10. Hereinafter, a direction in which the plurality of rows of the pressure generating chambers 12 are disposed is referred to as a second direction Y. Further, a direction that is orthogonal to the first direction X and the second direction Y is referred to as a direction of discharge of ink droplets (liquid droplets) or a third direction Z. The flow path forming substrate 10, the communicating plate 15, and the nozzle plate 20 are stacked in the third direction Z.

In addition, a supply path for each of the pressure generating chambers, which supply path has a smaller opening area than the pressure generating chambers 12 and provides flow path resistance of ink which flows into the pressure generating chambers 12, and the like may be disposed on one end portion sides of the pressure generating chambers 12 in the second direction Y on the flow path forming substrate 10.

In addition, the communicating plate 15 and the nozzle plate 20 are sequentially stacked on the one surface side of the flow path forming substrate 10. In other words, the communicating plate 15 is disposed on the one surface of the flow path forming substrate 10 and the nozzle plate 20 has the nozzles 21 and is disposed on the surface side of the communicating plate 15 opposite to the flow path forming substrate 10.

Nozzle communicating paths 16, which allow the pressure generating chambers 12 and the nozzles 21 to communicate with each other, are disposed in the communicating plate 15. The communicating plate 15 is larger in area than the flow path forming substrate 10, and the nozzle plate 20 is smaller in area than the flow path forming substrate 10. When the communicating plate 15 is disposed in this manner, the nozzles 21 of the nozzle plate 20 and the pressure generating chambers 12 are separated. Thus ink in the pressure generating chambers 12 is unlikely to be affected by thickening that is caused by the evaporation of moisture in ink occurring in the ink that is in the vicinity of the nozzles 21. In addition, the nozzle plate 20 has only to cover openings of the nozzle communicating paths 16 that allow the pressure generating chambers 12 and the nozzles 21 to communicate with each other. Thus the area of the nozzle plate 20 can be relatively small and is less costly. In one embodiment, a surface from which ink droplets are discharged with the nozzles 21 of the nozzle plate 20 and to which the nozzles 21 open is referred to as a liquid ejecting surface 20*a*.

In addition, a first manifold portion 17 and a second manifold portion 18 constituting a part of a manifold 100 are disposed on the communicating plate 15.

The first manifold portion 17 is disposed to penetrate the communicating plate 15 in a thickness direction (stacking direction of the communicating plate 15 and the flow path forming substrate 10 (third direction Z)). A second manifold portion 18 is disposed to be open to the nozzle plate 20 side of the communicating plate 15, without penetrating the communicating plate 15 in the thickness direction.

Furthermore, in the communicating plate 15, supply communicating paths 19 that communicate with the one end portions of the pressure generating chambers 12 (or that communicate with one end of the pressure generating chambers 12 that is opposite an end that communicates with the nozzles) in the second direction Y are disposed independently in the respective pressure generating chambers 12. The supply communicating path 19 allows the second manifold portion 18 and the pressure generating chamber 12 to communicate with each other. In other words, in one embodiment, the supply communicating paths 19, the pressure generating chambers 12, and the nozzle communicating paths 16 are disposed as individual flow paths communicating with the nozzles 21 and the second manifold portions 18.

A metal such as stainless steel and nickel (Ni), ceramics such as zirconium (Zr), or the like can be used as or in the communicating plate 15. The communicating plate 15 may employ a material whose linear expansion coefficient is equal to that of the flow path forming substrate 10. In other words, in a case where a material whose linear expansion coefficient is significantly different from that of the flow path forming substrate 10 is used as the communicating plate 15, warpage occurs through heating and cooling due to the difference between the linear expansion coefficient of the flow path forming substrate 10 and the linear expansion coefficient of the communicating plate 15. In one embodiment, the same material, that is, the silicon single crystal substrate is used as the communicating plate 15 as well as in the flow path forming substrate 10 and thus the occurrence of warpage caused by heat, cracks and peeling caused by heat, and the like can be suppressed.

The nozzles 21, which communicate with the pressure generating chambers 12 via the nozzle communicating paths 16, are formed on the nozzle plate 20. Specifically, the nozzles 21 that eject the same type of liquid (ink) are juxtaposed in the first direction X, and two rows of the nozzles 21 juxtaposed in the first direction X are formed in the second direction Y in one example.

The row of the nozzles 21 (nozzle group) is not limited to the nozzle group that is juxtaposed linearly in the first direction X. For example, the nozzle group may be a nozzle group that is configured such that the nozzles 21 juxtaposed in the first direction X are alternately arranged at positions shifted in the second direction Y in a so-called zigzag arrangement. In addition, the nozzle group may be configured such that a plurality of the nozzles 21 juxtaposed in the first direction X are arranged in the second direction Y in a shifted manner. In other words, the nozzle group may be configured by using the plurality of nozzles 21 disposed on the liquid ejecting surface 20*a*, and the arrangement thereof is not particularly limited.

However, in most cases, the direction in which the nozzles 21 are juxtaposed (first direction X) increases in length when the plurality of nozzles 21 (increased number of the nozzles) are arranged in high density. In other words, it is usual that the first direction X is a longitudinal direction and the second direction Y is a short direction in the head chip 2.

A metal such as stainless steel (SUS), an organic material such as a polyimide resin, a silicon single crystal substrate, or the like can be used as the nozzle plate 20. When a silicon single crystal substrate is used as the nozzle plate 20, the occurrence of warpage caused by heating and cooling, cracks and peeling caused by heat, and the like can be suppressed since the linear expansion coefficients of the nozzle plate 20 and the communicating plate 15 are equal to each other.

In addition, the pressure generating chambers 12 are arranged to correspond to the nozzles 21. Pressure generating units, which generate pressure change in ink, are disposed to correspond to the pressure generating chambers 12. Thus the plurality of pressure generating chambers 12 and a plurality of piezoelectric actuators 130, which are examples of the pressure generating units, are juxtaposed in the first direction X. A wiring member 121 (described in detail later), which supplies an electrical signal to the plurality of piezoelectric actuators 130 formed in high density, is connected to the piezoelectric actuators 130 by generating a space in a direction of juxtaposition of the piezoelectric actuators 130 on the substrate, that is, the first direction X (longitudinal direction). Accordingly, the width of the sheet-shaped wiring member 121 is arranged in the direction of juxtaposition of the piezoelectric actuators 130. In other words, when the width direction of the sheet-shaped wiring member 121 is the direction of juxtaposition of the piezoelectric actuators 130, the connection between the piezoelectric actuators 130 and the wiring member 121 can be performed smoothly even if the multiple piezoelectric actuators 130 are arranged with a high density.

A vibrating plate 50 is formed on the surface side of the flow path forming substrate 10 opposite to the communicating plate 15. In one embodiment, an elastic membrane 51 formed of silicon oxide, which is disposed on the flow path forming substrate 10 side, and an insulator film 52 formed of zirconium oxide, which is disposed on the elastic membrane 51, are disposed as or included in the vibrating plate 50. A liquid flow path such as the pressure generating chambers 12 is formed through anisotropic etching of the flow path forming substrate 10 from the one surface side (surface side where the nozzle plate 20 is bonded), and the other surface of the liquid flow path such as the pressure generating chambers 12 are defined by the elastic membrane 51.

In addition, a first electrode 60, a piezoelectric layer 70, and a second electrode 80 are formed to be stacked on the insulator film 52 of the vibrating plate 50 and constitute or are included in the piezoelectric actuator 130. Herein, the piezoelectric actuator 130 refers to a part that includes the first electrode 60, the piezoelectric layer 70, and the second electrode 80. In general, any one of the electrodes of the piezoelectric actuator 130 may be a common electrode, and the other electrode and the piezoelectric layer 70 are configured through patterning in each of the pressure generating chambers 12. Herein, a part that is configured by any one of the electrodes that is patterned and the piezoelectric layer 70 and is subjected to piezoelectric distortion caused through voltage application to both of the electrodes is referred to as a piezoelectric active portion.

In one embodiment, the first electrode 60 is the common electrode of the piezoelectric actuator 130 and the second electrode 80 is an individual electrode of the piezoelectric actuator 130. However, this may be reversed for the convenience of a drive circuit and wiring. In the example described above, the first electrode 60 is continuously disposed across the plurality of pressure generating chambers 12, and thus the first electrode 60 functions as a part of the vibrating plate. However, for example, only the first electrode 60 may serve as the vibrating plate, without being limited thereto, with the elastic membrane 51 and the insulator film 52 described above not disposed. In other words, the elastic membrane 51 and the insulator film 52 may be omitted. In addition, the piezoelectric actuator 130 itself may also serve practically as the vibrating plate. However, the first electrode 60 may be protected by an insulating protective film or the like, so as to prevent conduction between the first electrode 60 and ink in a case where the first electrode 60 is disposed directly on the flow path forming substrate 10. In other words, although an example in which the first electrode 60 is configured to be disposed on the substrate (flow path forming substrate 10) via the vibrating plate 50 is described in one embodiment, the first electrode 60 may be disposed directly on the substrate, without being limited thereto, with the vibrating plate 50 being omitted. In other words, the first electrode 60 may serve as the vibrating plate. In other words, to be on the substrate includes a state where another member is interposed (upward) therebetween as well as to be directly on the substrate.

Furthermore, one end portions of lead electrodes 90, which are drawn out of the vicinity of the end portions on the side opposite to the supply communicating paths 19, extend onto the vibrating plate 50, and are formed of gold (Au) or the like, are respectively connected to the second electrodes 80 that are the individual electrodes of the piezoelectric actuators 130. In addition, the wiring member 121 where a drive circuit 120 (described later) is disposed to drive the piezoelectric actuators 130, which are the pressure generating units, is connected to the other end portions of the lead electrodes 90. A flexible sheet-shaped wiring member such as a COF substrate can be used as the wiring member 121. The drive circuit 120 may not be disposed in the wiring member 121. In other words, the wiring member 121 is not so limited and COF substrate, and may include FFC, FPC, and the like.

The other end portions of the lead electrodes 90 connected to the wiring member 121 are disposed to be juxtaposed in the first direction X. It is conceivable to extend the other end portions of the lead electrodes 90 to the one end portion side of the flow path forming substrate 10 in the first direction X and juxtapose the other end portions of the lead electrodes 90 in the second direction Y. However, this results in an increase in the size and costs of the recording head because a space is required for the lead electrodes 90 to be routed to the one end portion side of the flow path forming substrate 10. In addition, the width of the lead electrodes 90 decreases and electrical resistance increases when the multiple piezoelectric actuators 130 are disposed in or with high density to increase the number of the nozzles. Accordingly, the piezoelectric actuators 130 may not be drive normally with the lead electrodes 90 routed in this manner where the electrical resistance is increased. In one embodiment, the other end portion sides of the lead electrodes 90 extend between the two rows of the piezoelectric actuators 130 juxtaposed in the first direction X and the other end portions of the lead electrodes 90 are juxtaposed in the first direction X so that the recording head 1 can be compact in size and lower in cost with no increase in size. An increase in electrical resistance can be suppressed in the lead electrodes 90, and the number of the nozzles can be increased with multiple piezoelectric actuators 130 that are disposed with a high density.

In addition, in one embodiment, the other end portions of the lead electrodes 90 are disposed between the rows of the piezoelectric actuators 130 in the second direction Y and the lead electrodes 90 and the wiring member 121 are connected with each other between the rows of the piezoelectric actuators 130. Thus the one wiring member 121 is connected to two rows of the piezoelectric actuators 130 via the lead electrodes 90. The wiring member 121 is not limited thereto in number, and the wiring member 121 may be disposed in each of the rows of the piezoelectric actuators 130. When the one wiring member 121 is disposed with the two rows of the piezoelectric actuators 130 as in one embodiment, a space where the wiring member 121 and the lead electrode 90 are connected with each other can be narrow and the recording head 1 can be compact in size. In a case where the wiring member 121 is disposed in each of the rows of the piezoelectric actuators 130, it is also conceivable to extend the lead electrodes 90 to the side opposite to the rows of the piezoelectric actuators 130. However, in such a configuration, an even wider space is required for the connection of the lead electrode with the wiring member and the number of the areas where the wiring member 121 is drawn out to the case member and the like becomes two, which results in the recording head 1 becoming larger in size. In other words, the two rows of the piezoelectric actuators 130 can be connected at the same time with the one wiring member 121 when the lead electrodes 90 are disposed between the two rows of the piezoelectric actuators 130. The width direction of the sheet-shaped wiring member 121, which is connected to the lead electrodes 90 in this manner, is arranged in the first direction X.

In addition, the protective substrate 30, which has substantially the same size as the flow path forming substrate 10, is bonded to the surface of the flow path forming substrate 10 on the side toward the piezoelectric actuators 130, which are the pressure generating units. The protective substrate 30 includes holding portions 31, which are spaces in which the piezoelectric actuators 130 are protected. The holding portions 31 are disposed independently in the respective rows configured with the piezoelectric actuators 130 juxtaposed in the first direction X, and a thickness-direction through-hole 32 is disposed between the two holding portions 31 (second direction Y). The other end portions of the lead electrodes 90 are extended to be exposed into the through-hole 32. The lead electrodes 90 and the wiring member 121 are electrically connected with each other in the through-hole 32.

In addition, the case member 40, which defines the manifolds 100 communicating with the plurality of pressure generating chambers 12 along with the head main body 11, is fixed to the head main body 11 having this configuration. The case member 40 has substantially the same shape, in a plan view, as the communicating plate 15 described above, is bonded to the protective substrate 30, and is also bonded to the communicating plate 15 described above. Specifically, the case member 40 includes a concave portion 41 with a depth at which the flow path forming substrate 10 and the protective substrate 30 are accommodated on the protective substrate 30 side. The concave portion 41 has an opening area which is larger than that of the surface of the protective substrate 30 bonded to the flow path forming substrate 10. An opening surface of the concave portion 41 on the nozzle plate 20 side is sealed by the communicating plate 15 in a state where the flow path forming substrate 10 and the like are accommodated in the concave portion 41. In this manner, a third manifold portion 42 is defined in an outer circumferential portion of the flow path forming substrate 10 by the case member 40 and the head main body 11. The first manifold portion 17 and the second manifold portion 18 that are disposed on the communicating plate 15 and the third manifold portion 42 that is defined by the case member 40 and the head main body 11 constitute the manifold 100 in one embodiment. In other words, the manifold 100 may include the first manifold portion 17, second manifold portion 18, and the third manifold portion 42. In addition, the manifolds 100 according to this embodiment are arranged on both outer sides of the two rows of the pressure generating chambers 12 in the second direction Y, and the two manifolds 100 that are disposed on both of the outer sides of the two rows of the pressure generating chambers 12 are disposed independently of each other so as not to communicate in the head chip 2. In other words, the one manifolds 100 are disposed to communicate with the respective rows (rows juxtaposed in the first direction X) of the pressure generating chambers 12. In other words, the manifold 100 is disposed for each of the nozzle groups. However, the two manifolds 100 may communicate with each other in one embodiment.

In addition, in the case member 40, an inlet 44, which is an example of a liquid connection, is disposed to communicate with the manifolds 100 and supply ink to the respective manifolds 100. The liquid connection is a part that is an inlet of ink supplied to the head chip or an outlet of ink not used in the head chip. In one embodiment, ink is supplied only to the head chip 2 and ink is not discharged from the head chip 2 through circulation. As such, the inlet 44 is formed as the only liquid connection in the head chip 2.

An upper surface of the case member 40 is formed to be substantially flat, and the inlet 44 is open to the upper surface. In other words, a part that protrudes to a downstream flow path member 220 side more than the inlet 44 is not present in the case member 40 in one example. This configuration of the case member 40 can facilitate an operation for fixing the head chip 2 to an accommodating space 226 (described in detail later).

In addition, a connection port 43, which communicates with the through-hole 32 of the protective substrate 30 for the wiring member 121 to be inserted, is disposed in the case member 40. The other end portion of the wiring member 121 extends in the direction opposite to the penetration directions of the through-hole 32 and the connection port 43, that is, the third direction Z, which is the direction of discharge of ink droplets.

Examples of the material that can be used in the case member 40 include resins and metals. When a resinous material is molded as the case member 40, mass production is available at a low cost.

In addition, a compliance substrate 45 may be disposed on a surface of the communicating plate 15 where the first manifold portion 17 and the second manifold portion 18 are open. The compliance substrate 45 has substantially the same size, in a plan view, as the communicating plate 15 described above. A first exposing opening 45*a* that exposes the nozzle plate 20 is disposed in the compliance substrate 45. The openings of the first manifold portion 17 and the second manifold portion 18 on the liquid ejecting surface 20*a* side are sealed in a state where the compliance substrate 45 exposes the nozzle plate 20 with the first exposing opening 45*a*.

In other words, the compliance substrate 45 defines a part of the manifold 100 in one example. The compliance substrate 45 may include a sealing film 46 and a fixed substrate 47 in one embodiment. The sealing film 46 may be formed of a flexible and film-shaped thin film (for example, a thin film with a thickness of 20 μm or less which is formed of polyphenylene sulfide (PPS) or the like), and the fixed substrate 47 may be formed of a hard material such as a metal, examples of which include stainless steel (SUS). An area of the fixed substrate 47 facing the manifold 100 is an opening 48 that is completely removed in the thickness direction, and thus one surface of the manifold 100 is a compliance portion 49 that is a flexible portion which is sealed only by the flexible sealing film 46. In one embodiment, one compliance portion 49 is disposed to correspond to one manifold 100. In other words, in one embodiment, the number of the manifolds 100 disposed is two, and thus the number of the compliance portions 49 is two, which are disposed on both sides in the second direction Y across the nozzle plate 20.

When ink is ejected, ink is introduced via the inlet 44 and inner portions of the flow paths reaching the nozzles 21 from the manifolds 100 are filled with ink in the head chip having this configuration. Then, a voltage is applied to the respective piezoelectric actuators 130, which correspond to the pressure generating chambers 12, according to a signal from the drive circuit 120 so that the vibrating plate 50 is subjected to a bending deformation along with the piezoelectric actuators 130. This results in an increase in the pressure in the pressure generating chambers 12, and ink droplets are ejected from the predetermined nozzles 21.

Figure 4:
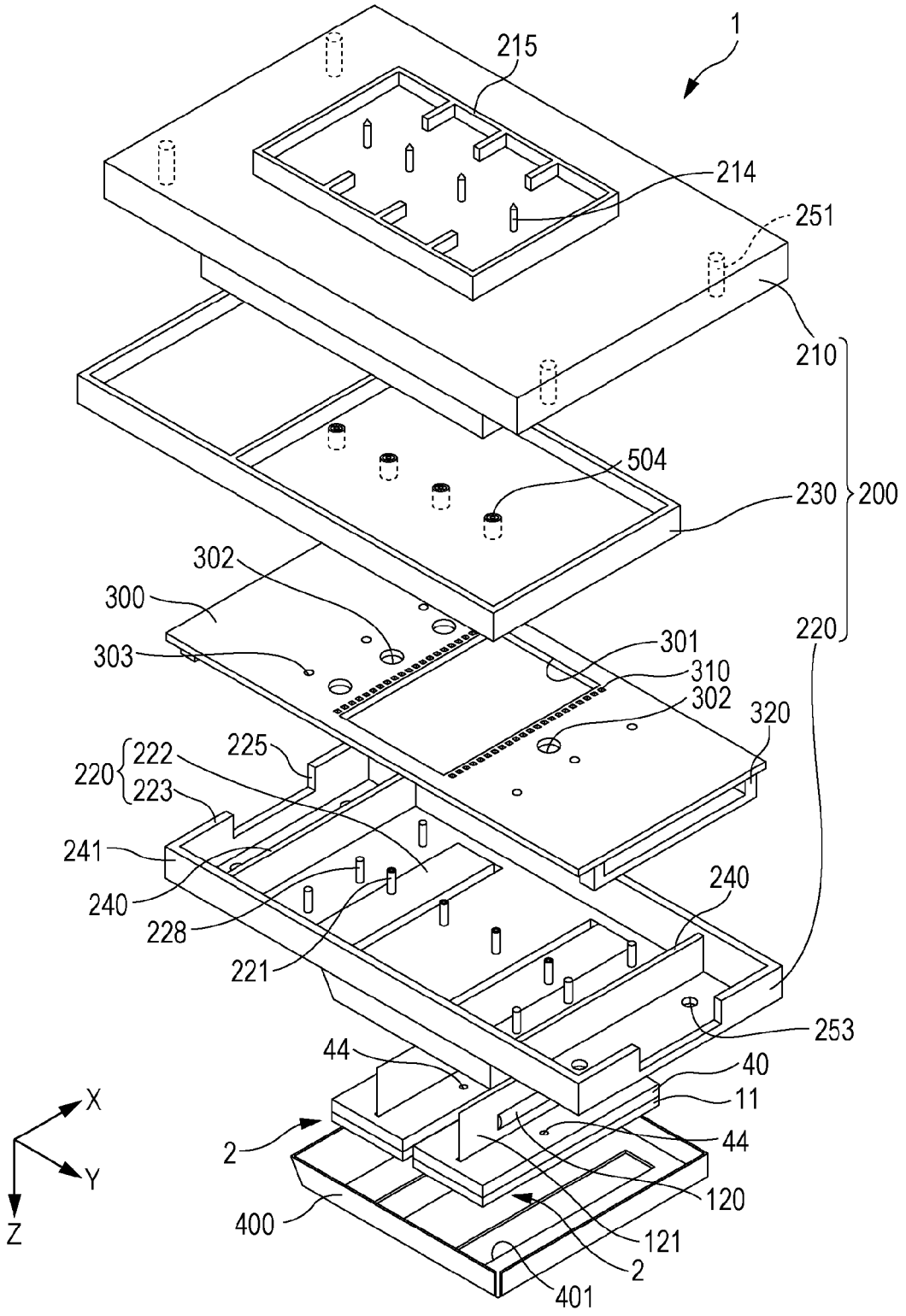
FIG. 4 is an exploded perspective view of a recording head.
Figure 5:
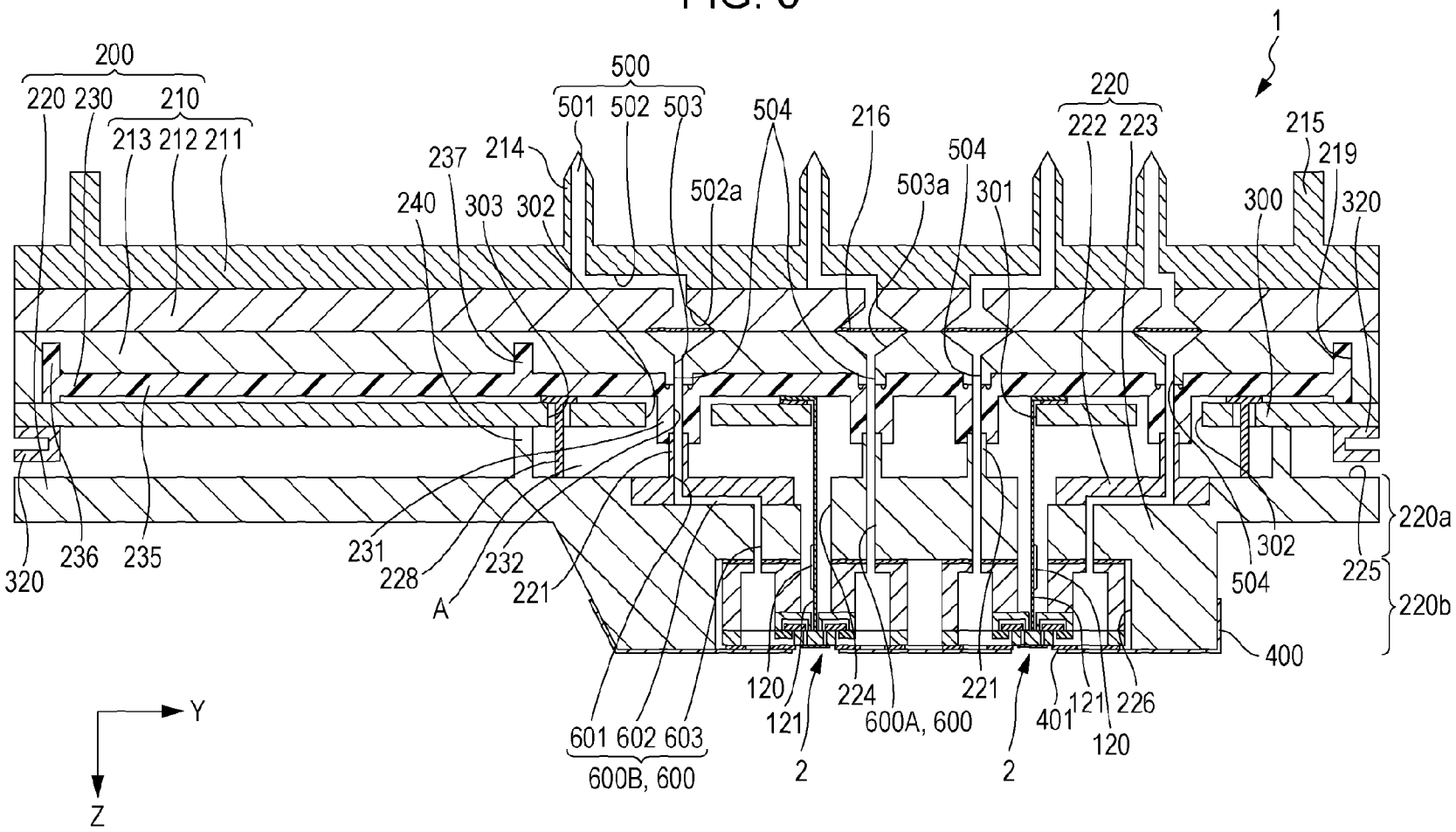
FIG. 5 is a sectional view of the recording head.
Figure 6:
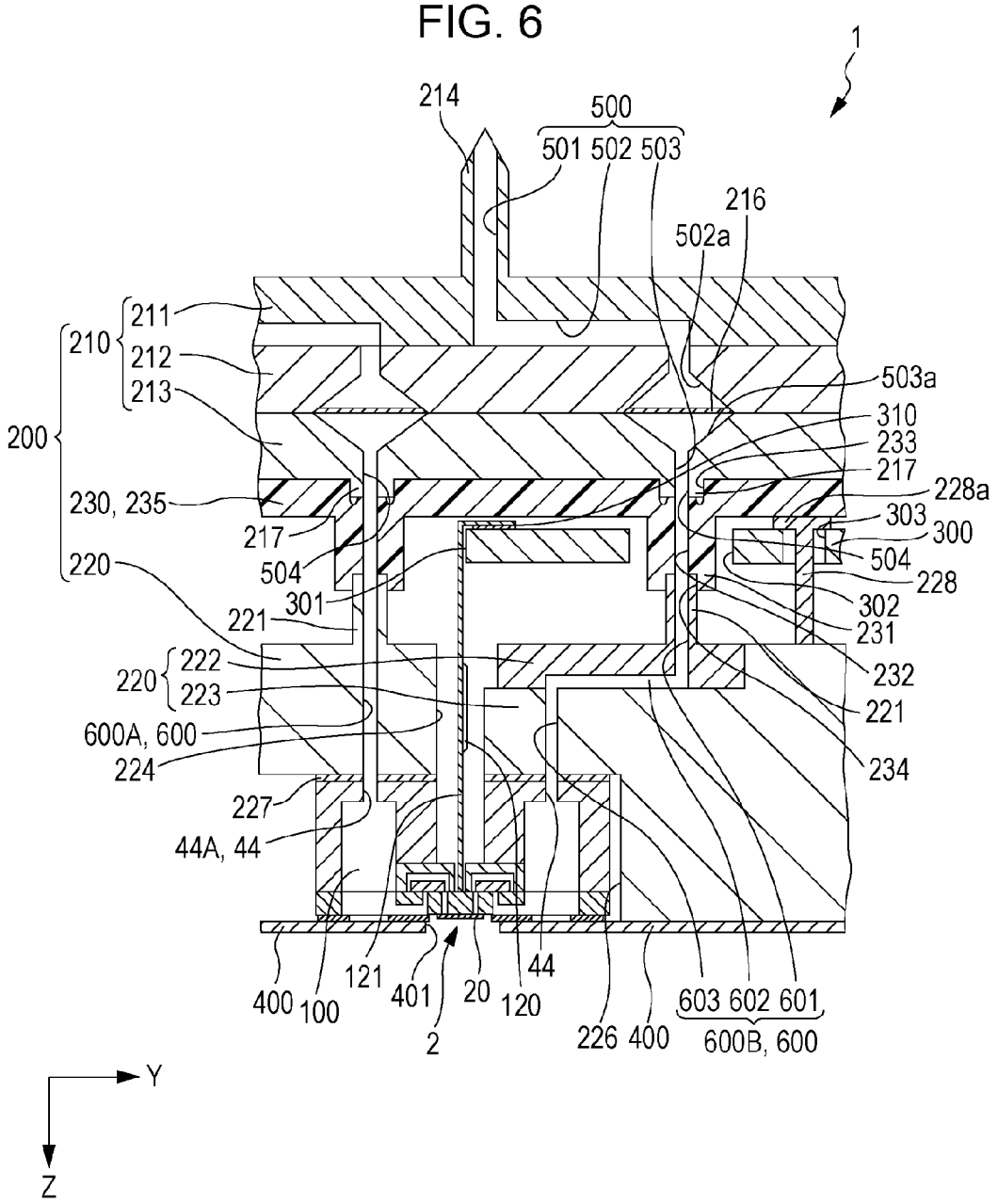
FIG. 6 is an enlarged sectional view of an example of a main part in FIG. 5.

The recording head 1 that includes the head chip 2 will be described in detail. FIG. 4 is an exploded perspective view of the recording head according to one embodiment. FIG. 5 is a sectional view of the recording head. FIG. 6 is an enlarged sectional view of a main part.

As illustrated in the drawings, the recording head 1 includes two head chips 2 that discharge ink (liquid) as ink droplets (liquid droplets) from the nozzles, a flow path member 200 that holds the two head chips 2 and supplies ink (liquid) to the head chips 2, a wiring substrate 300 that is held by the flow path member 200, and a cover head 400 that is disposed on the liquid ejecting surface 20*a* sides of the head chips 2. The cover head 400 is an example of a fixing member.

The flow path member 200 includes an upstream flow path member 210 that is an example of a first flow path member, a downstream flow path member 220 that is an example of a second flow path member, and a seal member 230 that is arranged between the upstream flow path member 210 and the downstream flow path member 220.

The upstream flow path member 210 includes an upstream flow path 500 that is an example of a first flow path which is a flow path for ink. In one embodiment, a first upstream flow path member 211, a second upstream flow path member 212, and a third upstream flow path member 213 are stacked in the third direction Z, in which ink droplets are discharged, to constitute the upstream flow path member 210. A first upstream flow path 501, a second upstream flow path 502, and a third upstream flow path 503 are respectively disposed in these members, and are connected to constitute the upstream flow path 500.

The upstream flow path member 210 is not particularly limited thereto, and may be a single member or may be configured using a plurality of, or two or more, members. In addition, a direction in which the plurality of members constituting or included in the upstream flow path member 210 are stacked is not particularly limited, and may be the first direction X or the second direction Y as well.

The first upstream flow path member 211 includes liquid connections 214, which may be connected to a liquid holding portion such as an ink tank and an ink cartridge where ink (liquid) is held, on the surface side opposite to the downstream flow path member 220. In one embodiment, the liquid connections 214 protrude in a needle shape. The liquid holding portion such as the ink cartridge may be directly connected to the liquid connections 214. The liquid holding portion such as the ink tank may be connected via a supply tube such as a tube. First upstream flow paths 501, to which ink is supplied from the liquid holding portion, are disposed in the liquid connections 214. In addition, guide walls 215 are disposed around the liquid connections 214 of the first upstream flow path member 211 so as to position the liquid holding portion.

Flow paths that extend in the third direction Z correspond to second upstream flow paths 502 (described later), flow paths that extend in planes including the directions orthogonal to the third direction Z, that is, the first direction X and the second direction Y correspond to second upstream flow paths 502, and the like constitute the first upstream flow paths 502. The flow paths 500, more generally may extend in the third direction Z and/or the first direction X and or the second direction Y, and/or combinations thereof.

The second upstream flow path member 212 is fixed to the surface side of the first upstream flow path member 211 opposite to the liquid connections 214 and includes the second upstream flow paths 502 which communicate with the first upstream flow paths 501. In addition, first liquid reservoir portions 502*a*, which are widened to be larger in inner diameter than the first upstream flow paths 501, are disposed on the downstream side (third upstream flow path member 213 side) of the second upstream flow paths 502.

The third upstream flow path member 213 is disposed on the side of the second upstream flow path member 212 opposite to the first upstream flow path member 211. In addition, third upstream flow paths 503 are disposed in the third upstream flow path member 213. Opening parts of the third upstream flow paths 503 on the second upstream flow path 502 side are second liquid reservoir portions 503*a*, which are widened to correspond to the first liquid reservoir portions 502*a*. Filters 216 are disposed at opening parts (between the first liquid reservoir portions 502*a* and the second liquid reservoir portions 503*a*) of the second liquid reservoir portions 503*a* so as to remove bubbles and foreign substances contained in ink. As such, ink that is supplied from the second upstream flow paths 502 (first liquid reservoir portions 502*a*) is supplied to the third upstream flow paths 503 (second liquid reservoir portions 503*a*) via the filters 216.

In addition, first protrusions 217, which protrude toward the downstream flow path member 220 side, are disposed on the downstream flow path member 220 side of the third upstream flow path member 213. The first protrusion 217 is disposed in each of the third upstream flow paths 503, and the outlets 504 are disposed to be open at respective tip end surfaces of the first protrusions 217.

The first upstream flow path member 211, the second upstream flow path member 212, and the third upstream flow path member 213 where the upstream flow paths 500 are disposed in this manner are integrally stacked by using, for example, an adhesive and/or welding. The first upstream flow path member 211, the second upstream flow path member 212, and the third upstream flow path member 213 can also be fixed by using a screw, a clamp, and the like. However, bonding may be performed by using an adhesive, welding, or the like so as to suppress the leakage of ink (liquid) from connection parts reaching the third upstream flow paths 503 from the first upstream flow paths 501.

In one embodiment, four liquid connections 214 are disposed in one upstream flow path member 210 and four independent upstream flow paths 500 are disposed in one upstream flow path member 210. A total of four inlets 44 are disposed to correspond to the respective upstream flow paths 500 in one example. In one embodiment, a connection is formed from one of the upstream flow paths 500 to one of the inlets 44 of the head chips 2, but the invention is not limited thereto. For example, the upstream flow path 500 may branch into at least two paths in the middle and the branching flow paths may each be connected to the inlets 44 of the head chip 2. As a result, each liquid connection may be associated with one or more inlets.

The downstream flow path member 220 is a member that is bonded to the upstream flow path member 210. The downstream flow path member 220 includes the accommodating space 226 where the head chip 2 is accommodated. The upstream flow path member 210 side of the downstream flow path member 220 is referred to as an upper surface side, and the side opposite to the upstream flow path member 210 is referred to as a lower surface side. The downstream flow path member 220 being bonded to the upstream flow path member 210 includes not only a direct contact between the upstream flow path member 210 and the downstream flow path member 220 but also a case where the upstream flow path member 210 and the downstream flow path member 220 are indirectly assembled with another component interposed therebetween.

In the downstream flow path member 220, the accommodating space 226 that is open to the lower surface side, that is, the liquid ejecting surface 20*a* side, is formed as a concave portion where the head chip 2 is accommodated. The accommodating space 226 according to one embodiment can accommodate two head chips. In addition, the depth of the accommodating space 226 (depth in the third direction Z) is slightly greater than the height of the head chip 2.

In addition, the downstream flow path member 220 has a downstream flow path 600 that is an example of a second flow path which is a flow path for ink. The second downstream flow path member 220 may include a first downstream flow path member 222 and a second downstream flow path member 223, and the downstream flow path 600 may be formed from these members. A downstream flow path 600A and a downstream flow path 600B, which are of two types with different shapes, are configured as the downstream flow path 600. The downstream flow path 600A is on one side of the wiring member 121 and the downstream flow path 600B is on the other side of the wiring member 121.

A first flow path 601 is formed in the first downstream flow path member 222, and a second flow path 602 is formed between the first downstream flow path member 222 and the second downstream flow path member 223. In addition, a third flow path 603 is formed in the second downstream flow path member 223.

Second protrusions 221 that protrude to the upstream flow path member 210 side are disposed, as a configuration that is common to both the downstream flow path 600A and the downstream flow path 600B, in the downstream flow path member 220 (each of the first downstream flow path member 222 and the second downstream flow path member 223). The second protrusion 221 is disposed for each of the upstream flow paths 500, that is, each of the first protrusions 217. In addition, one end of the downstream flow path 600 is open to a tip end surface of the second protrusion 221, and the other end of the downstream flow path 600 is disposed to be open to the surface on the side opposite to the upstream flow path member 210 in the third direction Z, that is, a bottom surface portion of the accommodating space 226.

The downstream flow path 600A is linearly formed in the third direction Z in the second downstream flow path member 223. In addition, the downstream flow path 600B includes the first flow path 601 that is connected to the upstream flow path 500 (outlet 504), the second flow path 602 that is connected to the first flow path 601, and the third flow path 603 that connects the second flow path 602 to the inlet 44. The first flow path 601 and the third flow path 603 are formed as through-holes of the second downstream flow path member 223 in the third direction Z. The second flow path 602 is formed as a groove that is formed on one surface of the first downstream flow path member 222 and is sealed by the second downstream flow path member 223. When the first downstream flow path member 222 and the second downstream flow path member 223 are bonded, the second flow path 602 can be formed with ease in the downstream flow path member 220.

In addition, the second flow path 602 is an example of an extending flow path that extends toward or in the second direction Y. Herein, the extension of the second flow path 602 toward or in the second direction Y means that a component (vector) toward the second direction Y is present in the direction of extension of the second flow path 602. The direction of extension of the second flow path 602 is the direction in which ink (liquid) in the second flow path 602 flows. Accordingly, the second flow path 602 includes those disposed in the horizontal direction (direction orthogonal to the third direction Z) and those disposed to intersect with the third direction Z and the horizontal direction (in-plane direction of the first direction X and the second direction Y). In one embodiment, the first flow path 601 and the third flow path 603 are disposed in the third direction Z and the second flow path 602 is disposed in the horizontal direction (second direction Y). The first flow path 601 and the third flow path 603 may be disposed in the direction intersecting with the third direction Z.

The downstream flow path 600B is not limited thereto, and a flow path other than the first flow path 601, the second flow path 602, and the third flow path 603 may also be present. In one example, the first flow path 601 or the third flow path 603 may not be disposed or present. In addition, a configuration in which only the second flow path 602 is the extending flow path has been described in the example described above, but, without being limited thereto, a plurality of flow paths that have components in the second direction Y may also be extending flow paths. Furthermore, the entire downstream flow path 600B may be an extending flow path.

The plurality of head chips 2, the two head chips 2 in one embodiment, are accommodated in the accommodating space 226 of the downstream flow path member 220. The rows of the nozzles are formed to be juxtaposed in the second direction Y in each of the head chips 2 (refer to FIGS. 1 and 2 for example), and the two head chips 2 are disposed to be juxtaposed in the second direction Y in the recording head 1. Hereinafter, the first direction X, the second direction Y, and the third direction Z of the head chip 2 respectively illustrate the same directions as the first direction X, the second direction Y, and the third direction Z of the recording head 1.

Two inlets 44 are disposed in each of the two head chips 2. The downstream flow paths 600 (the downstream flow path 600A and the downstream flow path 600B) that are disposed in the downstream flow path member 220 are disposed to be open and in alignment with the positions where the respective inlets 44 are open.

Each of the inlets 44 of the head chips 2 is aligned to communicate with the downstream flow path 600 that is open to the bottom surface portion of the accommodating space 226 of the downstream flow path member 220. The head chip 2 is fixed to the accommodating space 226 with an adhesive 227 that is disposed around each of the inlets 44. When the head chip 2 is fixed to the accommodating space 226 in this manner, the downstream flow path 600 and the inlet 44 communicate with each other and ink is supplied to the head chip 2.

Herein, each of the inlets 44 is positioned more to the downstream flow path member 220 side than any other than any other part in or of the head chip 2 as described above. In other words, a site or portion that would hinder contact between the inlet 44 of the head chip 2 and the bottom surface portion of the accommodating space 226 is not present in the head chip 2. As such, the head chip 2 having this configuration can facilitate an operation for connecting the inlets 44 to the respective downstream flow paths 600 and fixing the head chip 2 to the downstream flow path member 220 with the adhesive 227.

In addition, the inlet 44 of ink supplied to the head chip 2 is a bonding surface (surface on the downstream flow path member 220 side) of the head chip 2 on the side opposite to the liquid ejecting surface 20*a* and the downstream flow path 600 is configured to be open to the bottom surface portion of the accommodating space 226 in the downstream flow path member 220.

Herein, an assembly operation is performed by placing the downstream flow path member 220 from above the head chip 2, with the inlet 44 of the head chip 2 toward an upper side in a perpendicular direction and the accommodating space 226 toward a lower side in the perpendicular direction, and aligning the inlets 44 with the openings of the downstream flow paths 600.

In this case, no force is added in the horizontal direction to the downstream flow path member 220, and thus a state of alignment with the head chip 2 can be maintained. In other words, this configuration can suppress position shifts of the inlet 44 and the downstream flow path 600 during an operation for assembling the downstream flow path member 220 and the head chip 2. In other words, a relative shift between the inlet 44 and the downstream flow path can be suppressed during assembly. When the bonding surface of the head chip 2 is inclined from or with respect to a horizontal plane, the downstream flow path member 220 may be shifted with respect to the head chip 2 and an operation and equipment for suppressing the occurrence of the shift are required.

In addition, a second insertion hole 224 is disposed in the downstream flow path member 220. The second insertion hole 224 is disposed to be open to both the accommodating space 226 and the upstream flow path member 210 side of the downstream flow path member 220. The second insertion hole 224 communicates with the connection port 43 of the head chip 2 and allows the wiring member 121 to be inserted from the head chip 2 side to the upstream flow path member 210 side. The second insertion hole 224 is disposed as an opening having the substantially same width as the width of the head chip 2 in the first direction X.

Furthermore, supporting portions 240 (described later), on which the wiring substrate 300 is mounted, are formed in the downstream flow path member 220. Two supporting portions 240, in one example, are disposed to protrude to the upstream flow path member 210 side of the downstream flow path member 220, and are arranged across the second insertion hole 224 in the second direction Y. In addition, a side wall 241, which protrudes to the upstream flow path member 210 and surrounds the outer circumference of a surface on the upstream flow path member 210 side, is formed in the downstream flow path member 220. Each of the supporting portions 240 is disposed to connect two facing sides of the side wall 241. A space A that surrounds the second insertion hole 224 is formed in this manner by the supporting portions 240 and the side wall 241. The wiring substrate 300 is mounted on the supporting portions 240 and the seal member 230 is arranged on the wiring substrate 300 so that the space A is sealed.

The seal member 230, which is a joint connecting (linking) the upstream flow paths 500 and the downstream flow path 600 with each other, is disposed between the upstream flow path member 210 and the downstream flow path member 220. A material that has liquid resistance to a liquid, such as ink, used in the recording head 1 and an elastically deformable material (elastic material), such as rubber and an elastomer, can be used as the material of the seal member 230.

The seal member 230 has a plate-shaped base portion 235, and communicating paths 232 and third protrusions 231 (protrusions formed in the seal member) are formed in the base portion 235. In one embodiment, the number of the communicating paths 232 and the third protrusions 231 formed in the seam member 230 correspond to the respective upstream flow paths 500 and the respective downstream flow paths 600. In one example, the number are four.

A first concave portion 233 with an annular shape, into which the first protrusion 217 is inserted, is disposed on the upstream flow path member 210 side of the base portion 235. The first concave portion 233 is disposed at a position facing the third protrusion 231.

The third protrusions 231 protrude to the downstream flow path member 220 side and are disposed at positions facing the second protrusions 221 of the downstream flow path member 220. A second concave portion 234, into which the second protrusion 221 is inserted, is disposed on a top surface (surface facing the downstream flow path member 220) of the third protrusion 231.

The communicating path 232 penetrates the base portion 235 in the thickness direction (third direction Z), and has one end open to the first concave portion 233 and the other end open to the second concave portion 234. The third protrusion 231 is held, in a state where a predetermined pressure is applied in the third direction Z, between the tip end surface of the first protrusion 217 that is inserted into the first concave portion 233 and the tip end surface of the second protrusion 221 that is inserted into the second concave portion 234. The upstream flow path 500 and the communicating path 232 are connected in this manner in a state where pressure is applied in the third direction Z to the seal member 230, and the communicating path 232 and the downstream flow path 600 are connected in a state where pressure is applied in the third direction Z to the seal member 230. Accordingly, the upstream flow path 500 and the downstream flow path 600 communicate in a state where the upstream flow path 500 and the downstream flow path 600 are sealed via the communicating path 232.

In one embodiment, the upstream flow path 500 and the downstream flow path 600 may communicate by putting the first protrusion 217 and the second protrusion 221 into the communicating path 232. In other words, it is possible to connect the flow paths by bringing an inner surface of the communicating path 232 of the third protrusion 231 into close contact with an outer circumferential surface of at least one of the first protrusion 217 and the second protrusion 221, that is, by applying pressure in the first direction X that is a radial direction and a plane direction of the second direction Y.

Each of the sites constituting the recording head 1 may be an obstacle in applying pressure in the radial direction. For example, pressure has to be applied in the radial direction in the first insertion hole 301, into which the wiring member 121 and the like are inserted, in a case where pressure is applied in the radial direction to the inner surface of the communicating path 232 and the second protrusion 221. This makes the operation difficult.

However, the upstream flow path member 210 is not present yet above the seal member 230 in the third direction Z in a state where the wiring substrate 300 is arranged on the downstream flow path member 220 and the seal member 230 is arranged on the wiring substrate 300 (described in detail later). As such, pressure can be applied in the third direction Z to the seal member 230 and an operation for communicating or connecting the communicating path 232 with the downstream flow path 600 can be facilitated. This is similar to an operation for communicating or connecting the upstream flow path 500 with the communicating path 232 by applying pressure in the third direction Z with the upstream flow path member 210 arranged on the seal member 230.

In addition, a wall 236, which is formed to surround an outer circumference of the base portion 235 and protrudes to the upstream flow path member 210 side, is formed in the seal member 230. In one embodiment, the wall 236 is formed to have a quadrangular shape in a plan view to match with the substantially quadrangular base portion 235. Furthermore, a beam portion 237, which connects the facing walls 236, is formed on the upstream flow path member 210 side of the base portion 235.

The wall 236 and the beam portion 237 resist a force to twist the base portion 235, and thus the twisting of the base portion 235 can be suppressed. The wall 236 and the beam portion 237 are disposed in the plate-shaped base portion 235 of the seal member 230 in this manner, and thus the base portion 235 is configured to resist twisting. As such, the seal member 230 is easier to handle and can facilitate an operation for arranging the seal member 230 between the upstream flow path member 210 and the downstream flow path member 220. When the seal member has an annular shape and parts corresponding to the wall 236 and the beam portion 237 are not disposed, the seal member may be easily twisted and efforts must be taken to correct or untwist the seal member.

In addition, the wall 236 is pinched by the upstream flow path member 210 and the wiring substrate 300. In other words, an upper surface (surface on the upstream flow path member 210 side) of the wall 236 is pressed against the upstream flow path member 210 and a lower surface (surface on the wiring substrate 300 side) of the wall 236 is pressed against the wiring substrate 300. As such, a boundary part between the upstream flow path member 210 and the base portion 235 inside the wall 236 remain airtight and the evaporation of moisture in ink from the flow paths (the upstream flow path 500, the communicating path 232, and the downstream flow path 600) is suppressed.

Herein, a groove 219 is formed in the upstream flow path member 210 so as to suppress a failure in maintaining airtightness caused by the inclination or collapse of the wall 236 due to pressure at which the upstream flow path member 210 and the wiring substrate 300 are pinched.

Figure 7A:
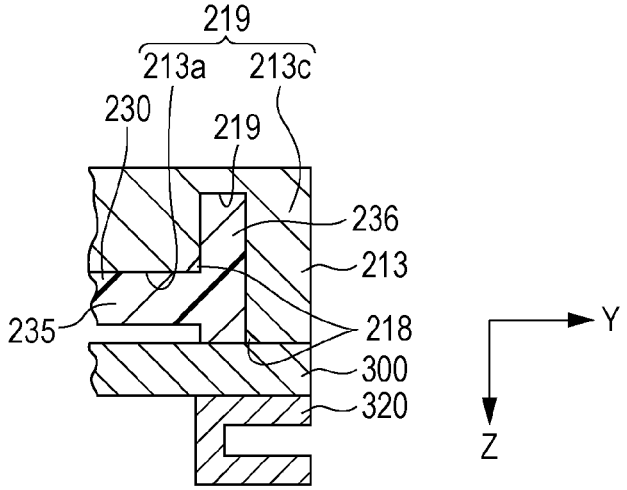
FIGS. 7A to 7C are enlarged sectional views of a wall of the recording head.
Figure 7B:
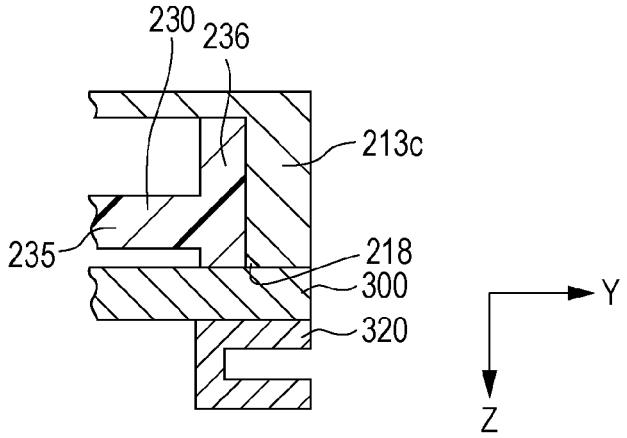
Figure 7C:
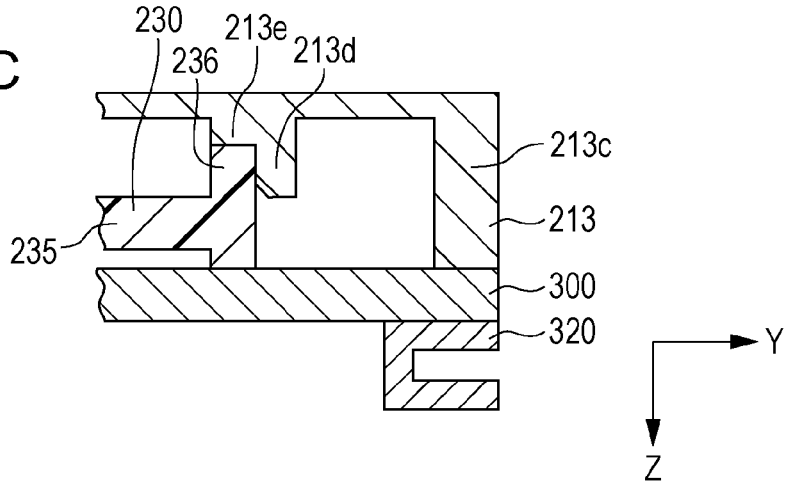

FIGS. 7A to 7C are enlarged sectional views of an example of the wall of the recording head. As illustrated in FIG. 7A, the groove 219, into which the wall 236 is fitted, is formed in the third upstream flow path member 213.

Specifically, the third upstream flow path member 213 includes a flat portion 213*a* that is in contact with the base portion 235, a concave portion 213*b* that is outside the flat portion 213*a* and that is more recessed to the second upstream flow path member 212 side than the flat portion 213*a*, and a leg portion 213*c* that is outside the concave portion 213*b* and that protrudes more to the seal member 230 side than the flat portion 213*a*.

The groove 219 is formed as the concave portion 213*b* is formed between the flat portion 213*a* and the leg portion 213*c*. The groove 219 is formed on a surface of the third upstream flow path member 213 on the seal member 230 side to match with the wall 236. The wall 236 may be formed to have an annular shape in a plan view. In addition, an opening 218 of the groove 219, that is, a boundary part between the flat portion 213*a* and the concave portion 213*b* may be chamfered. Furthermore, the seal member 230 side of the surface of the leg portion 213*c* facing the wiring substrate 300 may be chamfered.

The wall 236 is fitted into the groove 219. In this manner, a lateral inclination or collapse of the wall 236 due to pressure in the third direction Z given by the upstream flow path member 210 and the wiring substrate 300 is regulated by the groove 219.

Since the inclination and collapse of the wall 236 is regulated in this manner, the generation of a gap between the upper surface of the wall 236 and the third upstream flow path member 213 can be suppressed and the wall 236 can be airtight such that an area inside the wall 236 remains airtight.

Furthermore, the opening 218 of the groove 219 may be chamfered and the surface of the leg portion 213*c* facing the wiring substrate 300 may also be chamfered in the third upstream flow path member 213. As such, the wall 236 can be guided into the groove 219 when the third upstream flow path member 213 (upstream flow path member 210) is bonded to the seal member 230 arranged on the wiring substrate 300 from above in the third direction Z.

Herein, an operation for assembling the third upstream flow path member 213 is performed by arranging the seal member 230 on the wiring substrate 300 and arranging the third upstream flow path member 213 (upstream flow path member 210) on the seal member 230 so that the wall 236 is fitted into the groove 219.

In this case, no force is added in the horizontal direction to the seal member 230, and thus a state where each of the communicating paths 232 of the seal member 230 is aligned in the downstream flow path 600 can be maintained. In other words, according to this configuration, position shifts of the communicating path 232 and the downstream flow path 600 can be suppressed during an operation for assembling the third upstream flow path member 213 and the seal member 230. Thus relative positional shifts between the communicating path 232 and the downstream flow path 600 are suppressed. When a bonding surface between the seal member 230 and the third upstream flow path member 213 is inclined from or with respect to a horizontal plane, the seal member 230 may be shifted in position. In order to suppress the shift in position, an additional operation and equipment for holding the seal member 230 in place are required.

When the wall 236 is disposed in the seal member 230 and the groove 219 is disposed in the third upstream flow path member 213 in this manner, an operation for arranging the third upstream flow path member 213 (upstream flow path member 210) on the seal member 230 can be facilitated.

The configuration for suppressing the inclination and collapse of the wall 236 is not limited to the example illustrated in FIG. 7A. For example, in an alternative example, the leg portion 213*c* that is in contact with an outer side of the wall 236 may be disposed in the third upstream flow path member 213 as illustrated in FIG. 7B. According to this example, the leg portion 213*c* can suppress the inclination and collapse of the wall 236 to an outer side (leg portion 213*c* side).

In addition, a rib 213*d* as well as the leg portion 213*c* may be disposed in the third upstream flow path member 213, as illustrated in FIG. 7C, so as to suppress the inclination and collapse of the seal member 230.

Specifically, the rib 213*d*, which protrudes to the wiring substrate 300 side, may be formed on a more inner side than the leg portion 213*c* on the seal member 230 side of the third upstream flow path member 213. The rib 213*d* may be formed to have an annular shape in a plan view and is large enough for the seal member 230 to be accommodated inside. A rib 213*e*, which succeeds or follows the rib 213*d*, may be formed inside the rib 213*d*. The rib 213*e* is a site against which the upper surface of the wall 236 abuts, and is recessed more to the second upstream flow path member 212 side than the rib 213*d*.

The upper surface of the wall 236 abuts against the rib 213*e*, and a side surface of the wall 236 on the outer side abuts against the rib 213*d*.

Even in the third upstream flow path member 213 of this example, the inclination and collapse of the wall 236 to an outer side (leg portion 213*c* side) can be suppressed by the rib 213*d*.

As illustrated in FIGS. 4 to 6, the wiring substrate 300, to which the wiring member 121 is connected, may be disposed between the seal member 230 and the downstream flow path member 220. The insertion hole to which the wiring member 121 is inserted and the through-hole into which the protrusion of the seal member 230 is inserted are disposed in the wiring substrate. However, in the wiring substrate 300 according to one embodiment, the first insertion hole 301 serves as both the first insertion hole and the through-hole. In addition, a through-hole 302, into which only the third protrusion 231 of the seal member 230 is inserted, is disposed in the wiring substrate 300 as an example of the through-hole of the wiring substrate.

In other words, the first insertion hole 301 may be an opening into which two of the four third protrusions 231 and the wiring member 121 are inserted and the through-holes 302 may be openings into which the other two third protrusions 231 are respectively inserted The first insertion hole 301 according to one embodiment is formed to have a size that allows two wiring members 121 to be inserted. The two downstream flow paths 600 of the two head chips 2 are disposed between the two wiring members 121. Thus the third protrusion 231 (or third protrusions 231) of the seal member 230 corresponding to the downstream flow path 600 is inserted into the first insertion hole 301 with the wiring member 121.

In addition, the through-hole 302 is disposed for each of the third protrusions 231 that are disposed to correspond to two of the four downstream flow paths 600.

In one embodiment, the one wiring substrate 300 that is common to the two head chips 2 is disposed. However, embodiments of the invention re not limited thereto, and the wiring substrate 300 may be disposed in a divided manner for each one of the head chips 2.

When one wiring substrate 300 that is common to the two head chips 2 is used as in one embodiment, the number of components can be reduced and an assembly operation can be simplified.

In addition, the first insertion hole 301 can be disposed with a wider opening area when the two wiring members 121 and the two third protrusions 231 are inserted into the first insertion hole 301, which is one of openings of the wiring substrate 300, than in a case where a plurality of the openings are disposed. As such, the wiring member 121 can be drawn out with ease from the first insertion hole 301 and assemblability can be improved. In other words, the wiring member 121 has to be drawn out from the head chip 2 side of the wiring substrate 300 to the upstream flow path member 210 side so that the wiring member 121 and the wiring substrate 300 may be connected to each other. It is difficult to insert the wiring substrate 300, which has flexibility, into a narrow opening.

In addition, the wiring member 121 that is inserted into the one first insertion hole 301, which is one of the openings of the wiring substrate 300, is in an upright state in the third direction Z. The two second protrusions 221, which face the first insertion hole 301, are disposed in a linear shape in the third direction Z. As such, the opening area of the first insertion hole 301 can be as small as possible.

In addition, on the upstream flow path member 210 side surface of the wiring substrate 300, terminal portions 310, to which the wiring member 121 is connected, are disposed in open edge portions on both sides of the first insertion hole 301 in the second direction Y. The terminal portions 310 are formed over a width that is substantially equal to the width of the wiring member 121 in the first direction X. The terminal portion 310 is formed not beyond the through-hole 302 into which the third protrusion 231 is inserted. In other words, the terminal portion 310 is disposed between the first insertion hole 301 and the through-hole 302.

The other end portion of the wiring member 121 is inserted into the first insertion hole 301 of the wiring substrate 300 from the downstream flow path member 220 side. The other end portion of the wiring member 121 that is inserted into the first insertion hole 301 in this manner is bent in the second direction Y on the surface (surface on the upstream flow path member 210 side) of the wiring substrate 300 and is connected to the terminal portions 310 on the surface of the wiring substrate 300 on the upstream flow path member 210 side. In other words, the surface of the connection between the wiring member 121 and the wiring substrate 300 (terminal portions 310) is in the in-plane direction of the first direction X and the second direction Y.

When the other end portion of the wiring member 121 is bent in this manner, the wiring member 121 can have a low back and the recording head 1 can be compact in size in the third direction Z.

In addition, the wiring member 121 and the wiring substrate 300 are connected on the surface of the wiring substrate 300 on the upstream flow path member 210 side such that the wiring member 121 is connected to the terminal portion 310 along the surface of the wiring substrate 300. In other words, the wiring member 121 (or an end portion thereof) and the terminal portion 310 of the wiring substrate 300 are connected to overlap in the third direction Z.

When the wiring member 121 and the terminal portion 310 of the wiring substrate 300 are connected at the position overlapping in the third direction Z, the connection between the wiring member 121 and the wiring substrate 300 can be performed with ease from the one surface (upstream flow path member 210) side and assemblability can be improved. In other words, the assembly can be facilitated and the wiring member 121 and the wiring substrate 300 can be connected with ease when the head chip 2 is fixed to the downstream flow path member 220, the wiring member 121 is inserted into the second insertion hole 224 and inserted into the first insertion hole 301 of the wiring substrate 300, and then the end portion (which extends outside of the insertion holes) of the wiring member 121 inserted into the first insertion hole 301 and the second insertion hole 224 is connected to the wiring substrate 300 and more specifically to the terminal portion 310. For example, the wiring member 121 and the wiring substrate 300 are required to be connected in advance and then the head chip 2 is required to be fixed to the downstream flow path member 220 in order to connect the wiring member 121 with the wiring substrate 300 on the surface of the wiring substrate 300 on the downstream flow path member 220 side. In a case where the assembly is performed through this process, the wiring member 121 has to be lengthened so that the connected state can be maintained between the wiring member 121 and the wiring substrate 300 even in a state where the head chip 2 and the downstream flow path member 220 are not fixed. This results in high costs. In addition, when the head chip 2 and the downstream flow path member 220 are fixed, deflection occurs in the lengthened wiring member 121, the wiring on the wiring member 121 is subjected to damage due to contact with other members, and inconveniences such as disconnection and a short circuit may occur.

In one embodiment, the wiring member 121 and the wiring substrate 300 are connected on the surface of the wiring substrate 300 on the upstream flow path member 210 side so that the wiring member 121 and the terminal portion 310 of the wiring substrate 300 overlap in the third direction Z. Thus, deflection is unlikely to occur after the assembly of the wiring member 121 and the wiring member 121 can be disposed at the shortest distance (length) at which the head chip 2 and the wiring substrate 300 are linked. Accordingly, costs can be reduced.

In addition, in the downstream flow path member 220, caulking pins 228 are disposed to be upright on the wiring substrate 300 side. The caulking pins 228 are formed of a resin or the like that can be deformed through heating. In one embodiment, six caulking pins 228 are formed integrally with the downstream flow path member 220.

Six caulking holes 303 are formed in the wiring substrate 300 and the caulking pins 228 are inserted into the caulking holes 303 during assembly.

The caulking pin 228 is inserted into the caulking hole 303, and a top portion 228*a* of the caulking pin 228 is subjected to a thermal deformation such that the top portion 228*a* becomes larger than the caulking pin 228 in opening diameter. As such, the wiring substrate 300 that is mounted on the downstream flow path member 220 is fixed to the downstream flow path member 220 by the caulking pins 228.

In addition, the caulking pins 228 and the caulking holes 303 are also used to determine a predetermined position of or to position the wiring substrate 300 relative to the downstream flow path member 220. The predetermined position of the wiring substrate 300 described herein is a position where the second protrusion 221 of the downstream flow path member 220 faces the first insertion hole 301 and the through-hole 302 of the wiring substrate 300, that is, a position where each of the second protrusions 221 appears in the first insertion hole 301 and the through-hole 302 in a plan view.

Each of the caulking holes 303 and the caulking pins 228 is formed so that the wiring substrate 300 is placed at the predetermined position described above in a state where the caulking pins 228 are inserted into the corresponding caulking holes 303.

Accordingly, the wiring substrate 300 can be arranged at the predetermined position described above when the wiring substrate 300 is moved for the caulking pin 228 to be inserted into the caulking hole 303. Since the caulking pins 228 and the caulking holes 303 guide the wiring substrate 300 such that the wiring substrate 300 is arranged at a predetermined position in this manner, the wiring substrate 300 can be positioned in and fixed to the downstream flow path member 220 with ease.

In addition during assembly, the seal member 230 and the upstream flow path member 210 are not present yet above the caulking pins 228 in the third direction Z in a state where the wiring substrate 300 is arranged on the downstream flow path member 220 and the caulking pins 228 are inserted into the caulking holes 303 (described in detail later). As such, a thermal caulking operation using a tool such as a heat tool can be performed with ease from above the caulking pins 228 to deform the tips 228*a*.

A configuration in which the wiring substrate 300 is fixed to the downstream flow path member 220 is not limited to the caulking pin 228 and the caulking hole 303 described above, but may be by adhesion using an adhesive or fixing using a screw and the like. Also, a claw portion may be disposed in the downstream flow path member 220 so that the fixing is performed by engaging the claw portion with the wiring substrate 300.

As described above herein, the first insertion hole 301 (serving as an example of the through-hole) and the through-hole 302, into which the third protrusion 231 disposed in the seal member 230 is inserted, are formed in the wiring substrate 300.

The through-hole 302 may also be used to determine a predetermined position of the seal member 230 or to position the seal member 230. The predetermined position of the seal member 230 described herein is a position at a time when the third protrusion 231 faces the second protrusion 221 of the downstream flow path member 220.

The seal member 230 can be arranged at the predetermined position described above when the seal member 230 is moved so that the third protrusion 231 is inserted into the through-hole 302 of the wiring substrate 300 in a state where the wiring substrate 300 is fixed to the downstream flow path member 220 by the caulking hole 303 and the caulking pin 228 as described above. Since the first insertion hole 301 and the through-hole 302 guide the seal member 230 such that the seal member 230 is arranged at or placed at a predetermined position in this manner, the seal member 230 can be positioned in and fixed to the downstream flow path member 220 with ease.

In addition during assembly, the upstream flow path member 210 is not present yet above the seal member 230 in the third direction Z in a state where the seal member 230 is arranged on the wiring substrate 300 and the third protrusion 231 is inserted into the first insertion hole 301 and the through-hole 302 (described in detail later). As such, an operation for arranging the seal member 230 can be performed with ease.

Wiring (not illustrated), electronic components (not illustrated), and the like may be mounted on the wiring substrate 300, and the wiring that is connected to the terminal portions 310 is connected to connectors 320 that are disposed on both end portion sides of the wiring substrate 300 in the second direction Y. External wiring (not illustrated) is connected to the connectors 320. A connector connection port 225 that exposes the connectors 320 may be disposed in the downstream flow path member 220, and the external wiring is connected to the connectors 320 that are exposed by the connector connection port 225.

In addition, the cover head 400, which is an example of a fixing member, is mounted on the accommodating space 226 side of the downstream flow path member 220.

The cover head 400 may be a member to which the head chip 2 is fixed and a member that is fixed to the downstream flow path member 220. A second exposing opening 401, which exposes the nozzles 21, is disposed in the cover head 400. In one embodiment, the second exposing opening 401 has sufficient size to expose the nozzle plate 20, that is, the opening of the opening 201 is substantially the same as the first exposing opening 45*a* of the compliance substrate 45.

The cover head 400 is bonded to the surface side of the compliance substrate 45 opposite to the communicating plate 15 and seals the space on the side of the compliance portion 49 opposite to the flow path (manifold 100). When the compliance portion 49 is covered by the cover head 400 in this manner, breakage of the compliance portion 49 attributable to contact with a recording medium such as paper can be suppressed. In addition, attachment of ink (liquid) to the compliance portion 49 can be suppressed. Ink (liquid) attached to a surface of the cover head 400 can be wiped with, for example, a wiper blade, and contamination of the recording medium by ink attached to the cover head 400 or the like can be suppressed. Although not particularly illustrated, a space between the cover head 400 and the compliance portion 49 may be open to the atmosphere. The cover head 400 may also be disposed independently in each of the head chips 2.

The cover head 400, to which the two head chips 2 are fixed in this manner, is fixed to the lower surface side (liquid ejecting surface 20*a* side) of the downstream flow path member 220.

The head chip 2 may be smaller than each of the components constituting or included in the recording head 1. Accordingly, it is difficult to perform an operation for holding the head chip 2 and mounting the head chip 2 on the other members. However, two head chips 2 can be accommodated in the accommodating space 226 and can be fixed at the same time when the two head chips 2 are fixed to the cover head 400 and then the cover head 400 is fixed to the downstream flow path member 220. In other words, the two head chips 2, which are hard to handle, do not have to be individually accommodated in the accommodating space 226.

When the cover head 400, to which the head chips 2 are fixed in this manner, is adopted, the plurality of head chips 2 can be accommodated in the accommodating space 226 at the same time. Accordingly, an operation for assembling the recording head 1 can be facilitated.

As described above herein, the space A that is formed by the seal member 230, the wiring substrate 300, and the downstream flow path member 220 communicates with the accommodating space 226 via the second insertion hole 224. Since the cover head 400 is fixed to the downstream flow path member 220, the accommodating space 226 is sealed (the second exposing opening 401 that is disposed in the cover head 400 is sealed by the head chip 2 and does not communicate with the accommodating space 226).

When the seal member 230 is arranged in the downstream flow path member 220 and the accommodating space 226 is sealed with the cover head 400 in this manner, the space A, which is formed below the seal member 230 in the third direction Z, can be blocked from the outside. As such, in the space A, the evaporation of moisture in ink via, for example, a gap between the communicating path 232 of the seal member 230 and the second protrusion 221 can be suppressed.

In addition, the accommodating space 226, which is open to the side opposite to the upstream flow path member 210, is disposed in the downstream flow path member 220. The downstream flow path member 220 having this configuration is a site where an upper surface portion 220*a* on the upstream flow path member 210 side is subjected to pressure from above, and is configured so that a leg portion 220*b*, which forms the accommodating space 226, provides rigidity for the upper surface portion 220*a*.

As described above, pressure in the third direction Z is applied to the seal member 230 so as to allow the communicating path 232 which is formed in the third protrusion 231 to communicate with the upstream flow path 500 and the downstream flow path 600.

In a case where each of the head chips 2 is mounted on the lower surface side of the plate-shaped downstream flow path member with the accommodating space 226 not disposed or when the accommodating space 226 is not present, the upper surface portion 220*a* is bent due to pressure in the third direction Z applied to the seal member 230 and stress is generated in the head chip 2. This may result in the breakage of the head chip 2 and the peeling of the bonding portion between the head chip 2 and the downstream flow path member.

However, since the accommodating space 226 is disposed in the downstream flow path member 220, the bending of the upper surface portion 220*a* due to pressure in the third direction Z can be suppressed with or because of the rigidity of the leg portion 220*b*. Accordingly, the generation of stress in the head chip 2 accommodated or mounted in the accommodating space 226 can be suppressed.

Herein, reference marks that define relative positions of the cover head 400 and the downstream flow path member 220 may be formed in the cover head 400 and the downstream flow path member 220. The relative positions of the cover head 400 and the downstream flow path member 220 refer to the positions of the cover head 400 and the downstream flow path member 220 at a time when each of the head chips 2 fixed to the cover head 400 is accommodated in the accommodating space 226 of the downstream flow path member 220 and the inlet 44 of each of the head chips 2 is connected to the downstream flow path 600.

The reference marks defining the relative positions of the cover head 400 and the downstream flow path member 220 means that the cover head 400 and the downstream flow path member 220 are arranged at the relative positions if the reference marks respectively disposed at the cover head 400 and the downstream flow path member 220 have a predetermined positional relationship.

A method for forming the reference mark is not particularly limited, and may be any method that allows, by way of example only, optical recognition. Specific examples thereof may include printing with ink or the like and a pattern produced by cutting or the like of surfaces of the cover head 400 and the downstream flow path member 220.

Figure 8:
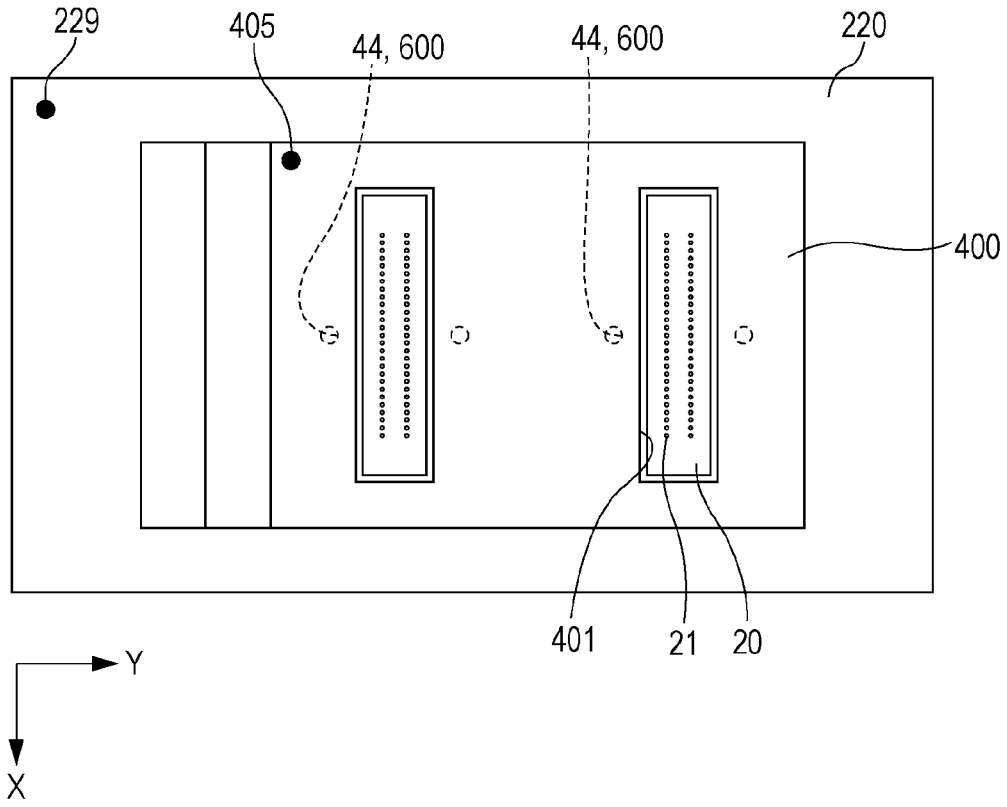
FIG. 8 is a bottom view of the recording head.

FIG. 8 is a bottom view of the recording head. As illustrated in the drawing, a first reference mark 229 is disposed on a bottom surface (surface defined by the first direction X and the second direction Y) of the downstream flow path member 220 toward the third direction Z in this embodiment. In addition, a second reference mark 405 is disposed on a bottom surface (surface on the side opposite to the head chip 2) of the cover head 400.

The first reference mark 229 is disposed at a predetermined distance apart, in each of the first direction X and the second direction Y, from the opening of the downstream flow path 600 that is open to the accommodating space 226 in a bottom view of the downstream flow path member 220.

The second reference mark 405 is disposed at a predetermined distance apart, in each of the first direction X and the second direction Y, from the inlet 44 in a bottom view of the cover head 400.

The first reference mark 229 indirectly illustrates the position of the downstream flow path 600 and the second reference mark 405 indirectly illustrates the position of the inlet 44. Accordingly, the inlet 44 can be arranged to communicate with the downstream flow path 600. In other words, a state where the cover head 400 and the downstream flow path member 220 are arranged at the relative positions can be achieved when the first reference mark 229 and the second reference mark 405 adjust the positions of the cover head 400 and the downstream flow path member 220 for a predetermined arrangement on a plane formed by the first direction X and the second direction Y. The head chip 2 is accommodated in the accommodating space 226 and the cover head 400 is fixed to the downstream flow path member 220 in a state where the relative positions are maintained.

When the first reference mark 229 and the second reference mark 405 are disposed in this manner, the cover head 400 and the downstream flow path member 220 can be easily arranged at the relative positions. A method for a predetermined arrangement of the first reference mark 229 and the second reference mark 405 is not particularly limited. For example, an imaging unit that images the cover head 400 and the downstream flow path member 220 from a bottom surface side can be used. The first reference mark 229 and the second reference mark 405 can be imaged by the imaging unit and the position of the downstream flow path member 220 can be adjusted with a micrometer or the like so that the images have a predetermined arrangement.

In addition, a method for fixing each of the head chip 2, the cover head 400, and the downstream flow path member 220 is performed by fixing the cover head 400, to which the head chip 2 is fixed, to the downstream flow path member 220 (described in detail later).

Specifically, the downstream flow path member 220 is pressed to the head chip 2 side from above in the third direction Z in a state where the cover head 400, to which the head chip 2 is fixed, is mounted and in a state where the cover head 400 and the downstream flow path member 220 maintain the relative positions.

The adhesive 227 is disposed on the upper surface of the head chip 2 where the inlet 44 is disposed, and is adhered to the bottom surface of the accommodating space 226 to which the downstream flow path 600 is open. The depth of the accommodating space 226 in the third direction Z is formed to be slightly greater than the height (height from the liquid ejecting surface 20*a* to the inlet 44 in the third direction Z) of the head chip 2.

Accordingly, a slight gap is formed between an opening edge portion of the inlet 44 of the head chip 2 and an opening edge portion of the downstream flow path 600 open to the bottom surface of the accommodating space 226. However, the adhesive 227 is disposed in this gap, and thus the inlet 44 and the downstream flow path 600 communicate with each other without a gap.

In other words, even when the depth of the accommodating space 226 and the height of the head chip 2 do not exactly match each other, the difference is covered by or filled with the adhesive 227 and thus the inlet 44 of the head chip 2 and the downstream flow path 600 open to the bottom surface of the accommodating space 226 can communicate with each other without a gap.

In addition, the accommodating space 226, which is open to the side opposite to the upstream flow path member 210, is disposed in the downstream flow path member 220. An operation for pressing and fixing the downstream flow path member 220 to the head chip 2 side from above the cover head 400 to which the head chip 2 is fixed can be performed with ease.

A method for fixing the downstream flow path member 220 and the head chip 2 is not limited to the adhesion with the adhesive 227, and examples thereof may include fixing by using a screw or the like.

Figure 9:
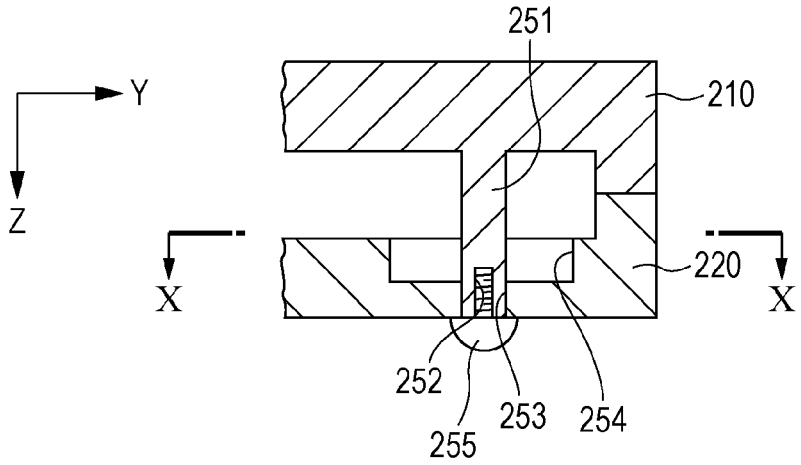
FIG. 9 is a sectional view of a main part of a bonding part between an upstream flow path member and the downstream flow path member.
Figure 10:
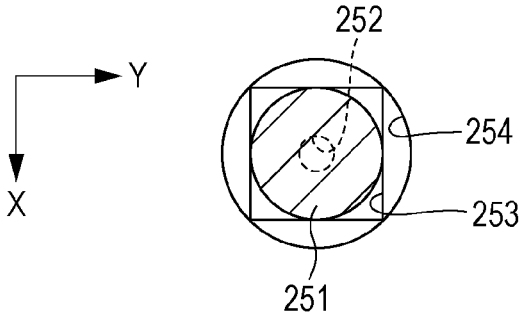
FIG. 10 is a sectional view taken along line X-X in FIG. 9.

Herein, a bonding part between the upstream flow path member 210 and the downstream flow path member 220 will be described. FIG. 9 is an enlarged sectional view of a main part illustrating an example of the bonding part between the upstream flow path member and the downstream flow path member. FIG. 10 is sectional view taken along line X-X in FIG. 9.

As illustrated in FIGS. 9, 10, and 4, a fixing pin 251 that protrudes to the downstream flow path member 220 side is formed in the upstream flow path member 210 and a fixing hole 253, into which the fixing pin 251 is inserted through penetration in the third direction Z is formed in the downstream flow path member 220. In this embodiment, four fixing pins 251 are disposed in respective corner portions of the upstream flow path member 210 and four fixing holes 253 are disposed at corner portions of the downstream flow path member 220 to correspond to the fixing pins 251.

The fixing pin 251 is formed to have a cylindrical shape, and a screw hole 252 is formed in a tip end portion of the fixing pin 251.

The fixing hole 253 has an inner surface that is in contact with a side surface of the fixing pin 251. In one embodiment, the fixing hole 253 is formed to have a quadrangular opening shape to circumscribe the side surface of the fixing pin 251. In addition, an opening 254, which is larger in diameter than the fixing hole 253, is disposed on the side of the fixing hole 253 into which the fixing pin 251 is inserted. The opening 254 is formed to be larger in external diameter than the fixing pin 251.

The fixing pin 251 is inserted into the fixing hole 253 and a fixing screw 255 is mounted on or screwed into the screw hole 252. The upstream flow path member 210 and the downstream flow path member 220 are fixed when the fixing screw 255 is mounted.

Since the opening 254 of the fixing hole 253 is formed to be larger than the fixing pin 251 in this manner, the fixing pin 251 can be inserted into the opening 254 with ease. This allows rough yet rapid positioning of the upstream flow path member 210 with respect to the downstream flow path member 220 when the upstream flow path member 210 is fixed to the downstream flow path member 220.

The fixing pin 251 can be inserted into the fixing hole 253 when the position of the upstream flow path member 210 is finely adjusted from a state where the fixing pin 251 is inserted into the opening 254. The fixing pin 251 circumscribes the fixing hole 253, and thus the movement of the fixing pin 251 in the first direction X and the second direction Y is regulated.

When the upstream flow path member 210 is fixed to the downstream flow path member 220 by the fixing pin 251 and the fixing screw 255, the upstream flow path 500 communicates with the communicating path 232 of the seal member 230 (refer to FIG. 5) and the wall 236 of the seal member 230 is arranged inside the leg portion 213*c* (refer to FIGS. 7A to 7C).

The upstream flow path member 210 and the downstream flow path member 220 are fixed as the fixing screw 255 is mounted on or screwed into the screw hole 252.

The fixing pin 251 may be formed in the downstream flow path member 220 and the fixing hole 253 may be formed in the upstream flow path member 210. In addition, the fixing hole 253 does not necessarily have to have an inner surface that is in contact with an outer surface of the fixing pin 251. In other words, a gap may be present between the inner surface of the fixing hole 253 and the outer surface of the fixing pin 251.

Hereinafter, a method for manufacturing the recording head 1 having the configuration described above will be described. FIGS. 11A to 13B are sectional views illustrating an example of the method for manufacturing the recording head. FIGS. 14A and 14B are sectional views of a main part illustrating the method for manufacturing the recording head.

Figure 11A:
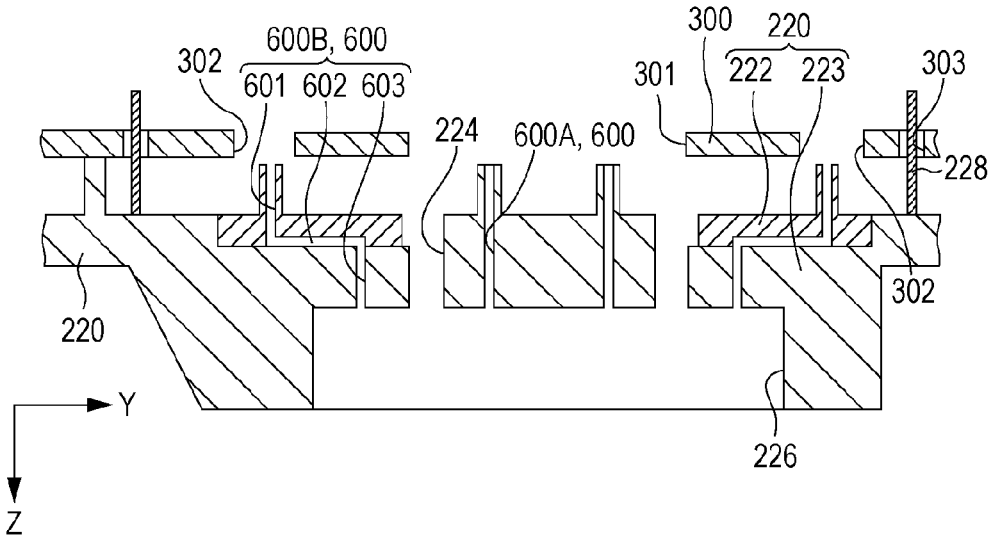
FIGS. 11A and 11B are sectional views illustrating a method for manufacturing the recording head.

First, the wiring substrate 300 is mounted on the downstream flow path member 220 as illustrated in FIG. 11A. For example, the caulking pin 228 is inserted into the caulking hole 303 of the wiring substrate 300.

As described above, the caulking pin 228 and the caulking hole 303 are disposed in order to arrange or position the wiring substrate 300 at a predetermined position with respect to the downstream flow path member 220. In other words, when the wiring substrate 300 is moved for the caulking pin 228 to be inserted into the caulking hole 303, the second protrusion 221 of the downstream flow path member 220 can arrange the wiring substrate 300 at positions facing the first insertion hole 301 and the through-hole 302 of the wiring substrate 300.

The caulking pin 228 and the caulking hole 303 guide the wiring substrate 300 in this manner so that the wiring substrate 300 is arranged at a predetermined position, and thus the wiring substrate 300 can be easily positioned in and fixed to the downstream flow path member 220.

Figure 11B:
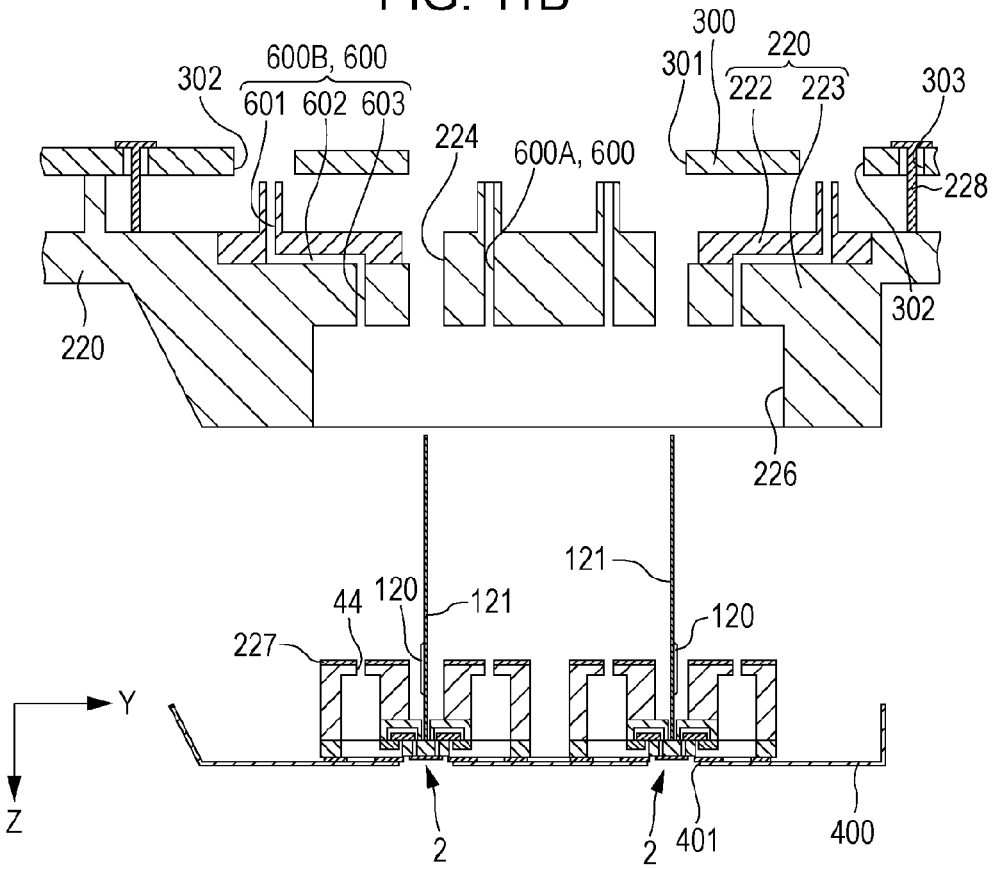

Next, as illustrated in FIG. 11B, the wiring substrate 300 is fixed as a tip end part of the caulking pin 228 is subjected to thermal caulking. As described above, the seal member 230 and the upstream flow path member 210 are not present yet above the caulking pin 228 in the third direction Z in a state where the wiring substrate 300 is arranged on the downstream flow path member 220 and the caulking pin 228 is inserted into the caulking hole 303. As such, a thermal caulking operation using a tool such as a heat tool can be performed with ease from above the caulking pin 228.

After the wiring substrate 300 is mounted on and fixed on the downstream flow path member 220 in this manner, the cover head 400, to which the head chip 2 is fixed, is mounted on the downstream flow path member 220.

Specifically, the cover head 400, to which the head chip 2 is fixed, is mounted so that the liquid ejecting surface 20*a* (refer to FIG. 3) is vertical to the third direction Z as illustrated in FIG. 11B, and the downstream flow path member 220 is arranged on the cover head 400.

In this case, the positions of the downstream flow path member 220 and the cover head 400 in the first direction X and the second direction Y are adjusted so that the first reference mark 229 and the second reference mark 405 described above have a predetermined arrangement. In this manner, the downstream flow path member 220 is arranged at a position where the head chip 2 is accommodated in the accommodating space 226, the inlet(s) 44 communicates with the downstream flow path(s) 600, and the wiring member(s) 121 is inserted into the second insertion hole 224.

In addition, the adhesive 227 is disposed in advance on the upper surface of the head chip 2 on the inlet 44 side and an adhesive (not illustrated) is also disposed in advance on the surface of the cover head 400 on the downstream flow path member 220 side. In addition, the wiring member 121 is held to be parallel in the third direction Z. The head chip 2 is fixed to the cover head 400 so that the relative positions of the respective nozzles 21 of the respective head chips 2 have a predetermined arrangement.

Figure 12A:
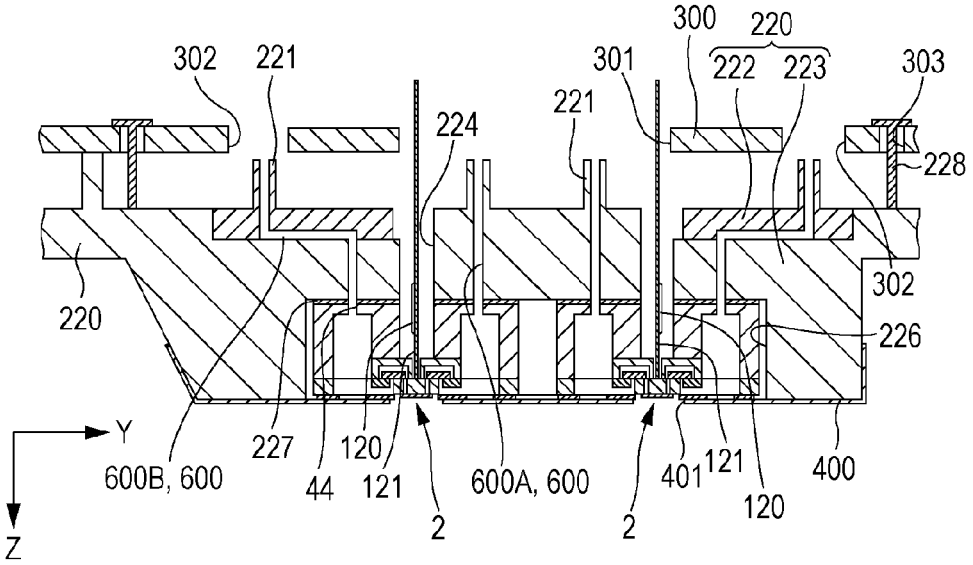
FIGS. 12A and 12B are sectional views illustrating the method for manufacturing the recording head.

Then, as illustrated in FIG. 12A, the downstream flow path member 220 is moved to the cover head 400 side in the third direction Z, and is pressed against and adhered to the cover head 400. In this manner, the downstream flow path member 220 and the cover head 400 can be fixed in a state where the head chip 2 is accommodated in the accommodating space 226, the inlet 44 communicates with the downstream flow path 600, and the wiring member 121 is inserted into the first insertion hole 301 and the second insertion hole 224. More generally, the inlets 44 communicate with corresponding paths 600 and the wiring members 121 are inserted into the insertion holes 301 and 224 from below in one example.

The accommodating space 226, which is open to the side opposite to the upstream flow path member 210, is disposed in the downstream flow path member 220. Accordingly, an operation for pressing the downstream flow path member 220 against the head chip 2 side and fixing the downstream flow path member 220 to the head chip 2 side from above the cover head 400, to which the head chip 2 is fixed, can be performed with ease.

Herein, in a case where each of the head chips 2 is simply accommodated in and fixed to the accommodating space 226 of the downstream flow path member 220 without using the cover head 400, it is difficult to align the liquid ejecting surfaces 20*a* on the same plane due to the variations of the thickness of the adhesive 227 disposed on the inlet 44 side of the head chip 2.

However, in the recording head 1 according to one embodiment, the head chip 2 is fixed to the cover head 400 and thus the liquid ejecting surfaces 20*a* of the respective head chips 2 can be arranged, in advance and with high accuracy, on the same plane and each of the head chips 2 can be mounted on the downstream flow path member 220 with the cover head 400 with this state maintained.

In addition, the first insertion hole 301 according to one embodiment is formed to have a wider opening area than in a case where a plurality of the first insertion holes 301 are individually disposed to correspond to each of the two wiring members 121. Thus the wiring member 121 can be easily drawn out of the first insertion hole 301 and assembly can be improved. Because the wiring member 121 has flexibility, it is difficult to maintain the posture of the member and the alignment is difficult when the opening area is small. However, the wide opening area facilitates the alignment. In addition, an operation for assisting in the maintenance of the posture from the upper surface side can also be facilitated.

Furthermore, the adhesive 227 covers the difference between the depth of the accommodating space 226 and the height of the head chip 2 even when the depth of the accommodating space 226 and the height of the head chip 2 do not exactly match each other, and thus the inlet 44 of the head chip 2 can communicate, without a gap, with the downstream flow path 600 that is open to the bottom surface of the accommodating space 226.

Figure 12B:
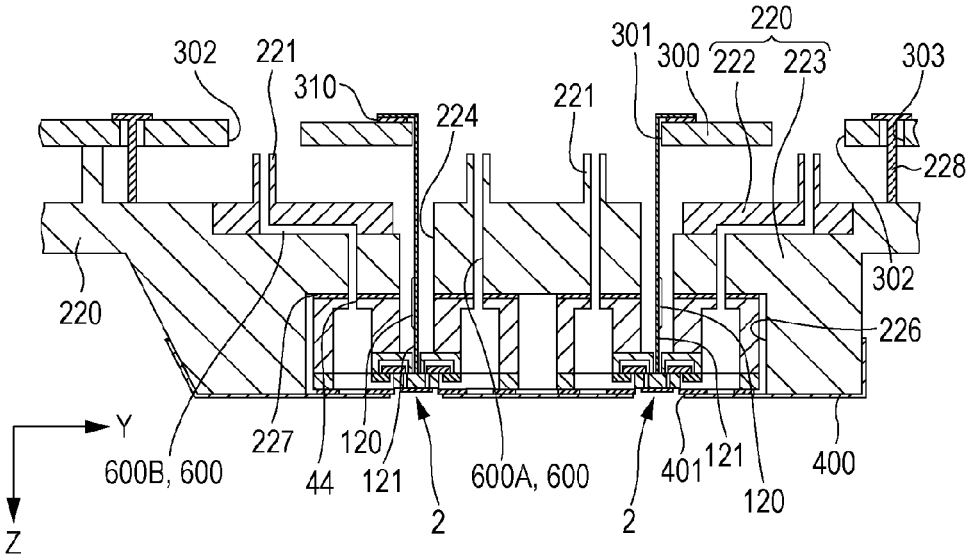

Next, as illustrated in FIG. 12B, the tip end portion of the wiring member 121 is bent and is electrically bonded to the terminal portion 310 of the wiring substrate 300. When the wiring member 121 is electrically bonded to the terminal portion 310, the seal member 230 and the upstream flow path member 210 are not present on the wiring substrate 300 in the third direction Z or have not been assembled yet. As such, an operation for electrically connecting the wiring member 121 to the terminal portion 310 from above the wiring substrate 300 can be performed with ease.

Next, the seal member 230 is mounted on the wiring substrate 300 and the communicating path 232 of the seal member 230 is allowed to or is arranged to communicate with the downstream flow path 600. As described above, the third protrusion 231 of the seal member 230 is inserted into the through-hole 302 of the wiring substrate 300, and thus the function of guiding the communicating path 232 to the downstream flow path 600 can be achieved at least in part by the through-hole 302.

Figure 13A:
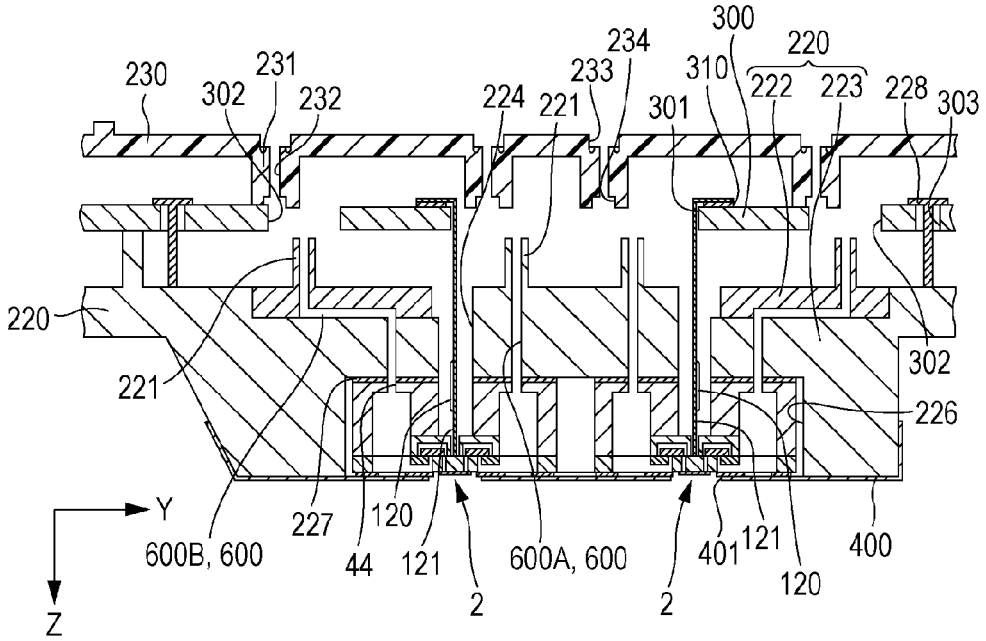
FIGS. 13A and 13B are sectional views illustrating the method for manufacturing the recording head.
Figure 13B:
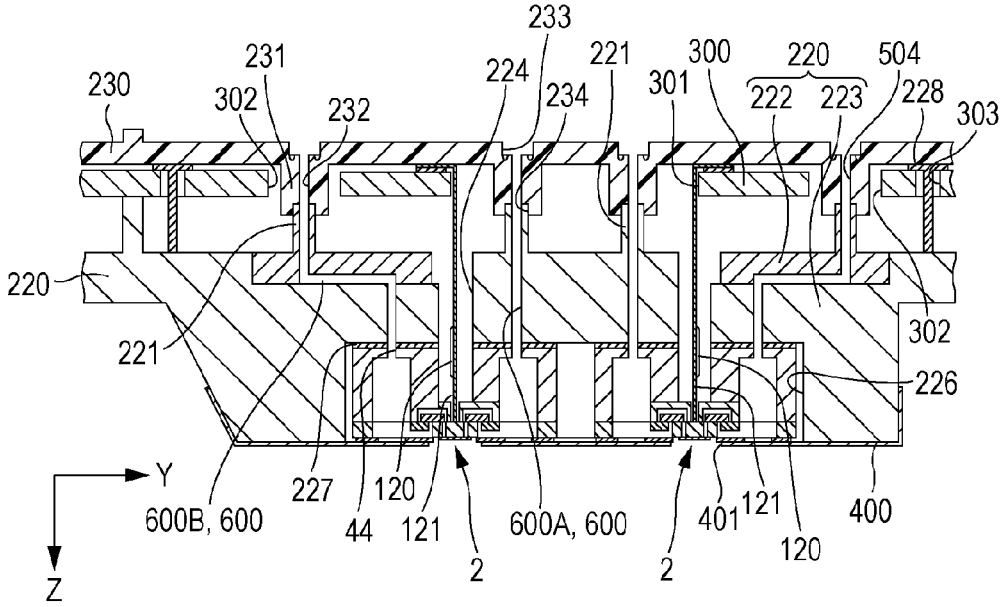
Figure 14A:
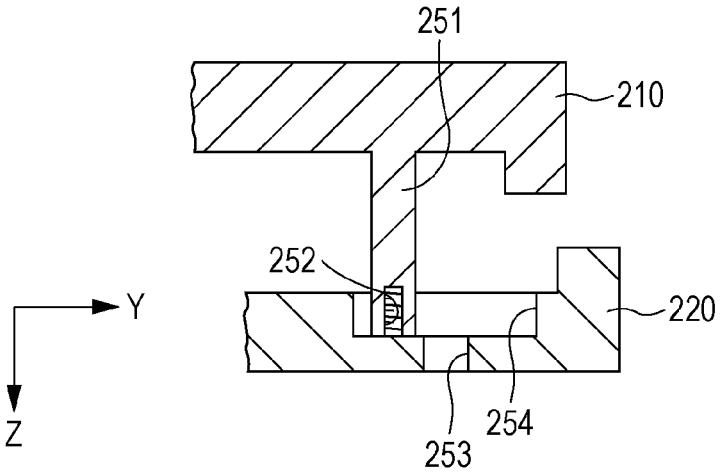
FIGS. 14A and 14B are sectional views of a main part illustrating the method for manufacturing the recording head.
Figure 14B:
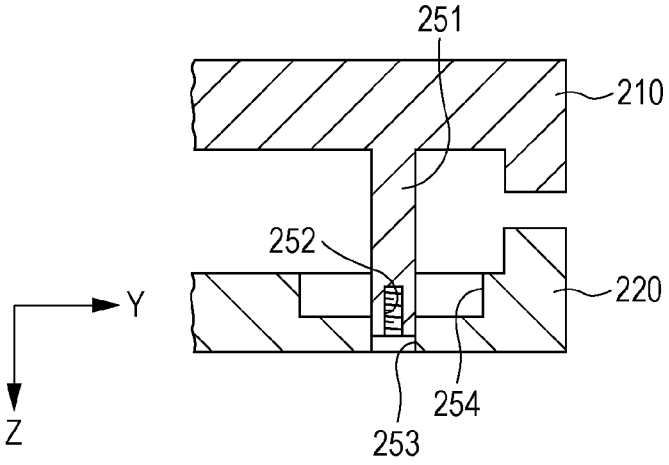

In other words, even when the seal member 230 is arranged at an approximate position on the wiring substrate 300 as illustrated in FIG. 13A, the third protrusion 231 is inserted into the through-hole 302 as illustrated in FIG. 13B if the seal member 230 is slightly moved in the first direction X and the second direction Y. Then, the communicating path 232 of each of the third protrusions 231 can be allowed to communicate with the downstream flow path 600 when the third protrusion 231 is inserted into the through-hole 302. Specifically, the communicating path 232 and the downstream flow path 600 are allowed to communicate with each other by inserting the second protrusion 221 into the second concave portion 234 that is formed in the third protrusion 231.

The third protrusion 231 and the through-hole 302 guide the seal member 230 in this manner to arrange the seal member 230 at a predetermined position or at an appropriate position relative to the downstream flow path member 220. As such, the seal member 230 can be positioned in and fixed to the downstream flow path member 220 with ease.

In addition, the upstream flow path member 210 is not present yet above the seal member 230 in the third direction Z when the seal member 230 is arranged on the wiring substrate 300. Accordingly, an operation for arranging the seal member 230 can be performed with ease.

Next, the upstream flow path member 210 is fixed to the downstream flow path member 220 with the seal member 230 and the wiring substrate 300 pinched therebetween as illustrated, for example, in FIG. 5.

Specifically, the fixing pin 251 of the upstream flow path member 210 is inserted into the opening 254 of the downstream flow path member 220 as illustrated in FIG. 14A so that an approximate position of the upstream flow path member 210 is determined with respect to the downstream flow path member 220. Then, the position of the upstream flow path member 210 is finely adjusted in the first direction X and the second direction Y as illustrated in FIG. 14B to insert the fixing pin 251 into the fixing hole 253. Then, the fixing pin 251 is fixed with the fixing screw 255 (refer to FIG. 9).

Since the fixing pin 251 is inserted into the opening 254 in this manner when the upstream flow path member 210 is fixed to the downstream flow path member 220, a rough yet rapid positioning of the upstream flow path member 210 with respect to the downstream flow path member 220 can be performed. Since the fixing pin 251 is inserted into the fixing hole 253, the upstream flow path member 210 and the downstream flow path member 220 can be fixed in a state where the upstream flow path 500 communicates with the communicating path 232 and the seal member 230 and the wiring substrate 300 are pinched.

In addition, since the accommodating space 226 is formed in the downstream flow path member 220 as described above, no stress is generated in the head chip 2 even when pressure is applied in the third direction Z. The upstream flow path member 210 and other members above the downstream flow path member 220 can be assembled while suppressing stress from being generated in the head chip 2. The seal member 230 may be just slightly moved in the first direction X and/or the second direction Y for positioning, and the upstream flow path 500 and the downstream flow path 600 are allowed to communicate as pressure is applied in the third direction Z. In other words, according to this structure, the seal member 230 can be assembled with the upstream flow path member 210 and the downstream flow path member 220 through the movement in the third direction Z or the application of pressure alone in actuality. This may establish communication between the upstream flow path 500 and the downstream flow path 600 through the path 232 formed in the third insertion member 231.

Since the accommodating space 226 is formed in the downstream flow path member 220 in this manner, the application of stress to the head chip 2 can be suppressed while joining the seal member 230 to the downstream flow path member 220 and an operation for assembling the seal member 230 can be performed with ease.

As described above, the recording head 1 can be assembled by stacking the respective members in the third direction Z. In other words, no member is moved in the first direction X or the second direction Y, although some members may be slightly moved for positioning purposes while stacking the members. In addition, the respective members are supported by the other members that are positioned below the respective members in the third direction Z after being assembled with the other members. Thus it is unnecessary to maintain the postures and the positions of the members with special equipment. In this manner, the recording head 1 has a structure particularly suitable for machine-based automatic assembly, and the costs associated with the assembly of the recording head 1 can be reduced significantly.

Embodiments of the invention have been described above, but the basic configurations of embodiments of the invention are not limited to the above description.

For example, in the embodiments described above, the recording head 1 where the two head chips 2 are disposed has been described. However, the number of the head chips 2 is not particularly limited. The recording head 1 may include one head chip or the recording head 1 may include three or more head chips 2.

In addition, the two wiring members 121 and the third protrusions 231 corresponding to the two downstream flow paths 600 are inserted into the first insertion hole 301 in the first embodiment described above. However, embodiments are not particularly limited thereto. The first insertion hole into which the wiring member 121 is inserted and the through-hole into which the third protrusion 231 is inserted may be disposed individually. In addition, the through-hole may be disposed independently in each of or for the third protrusions 231.

Furthermore, the flow path member 200 that includes the upstream flow path member 210 where the upstream flow path 500 is disposed and the downstream flow path member 220 where the downstream flow path 600 is disposed has been described above. However, for example, the upstream and the downstream may be reversed in a case where ink (liquid) is circulated. In other words, ink that is supplied to the head chip 2 may be allowed to flow from the downstream flow path 600 to the upstream flow path 500 to be discharged (circulated) to the liquid holding portion, a storage portion where discharged ink is stored, and the like.

In addition, the thin film type piezoelectric actuator 130 has been included and described above as the pressure generating unit that causes pressure change in the pressure generating chamber 12, but embodiments are not limited thereto. For example, a thick film type piezoelectric actuator that is formed using a method such as green sheet pasting, a vertical vibration type piezoelectric actuator in which a piezoelectric material and an electrode forming material are stacked alternately to be expanded and contracted in an axial direction, and the like can also be used as pressure generating units. In addition, a pressure generating unit that discharges liquid droplets from a nozzle opening by generating bubbles through heating by heater elements which are arranged in a pressure generating chamber may be used. A so-called electrostatic actuator that discharges liquid droplets from a nozzle opening by deforming a vibrating plate with the electrostatic force of static electricity that is generated between the vibrating plate and an electrode, and the like can also be used as pressure generating units.

Figure 15:
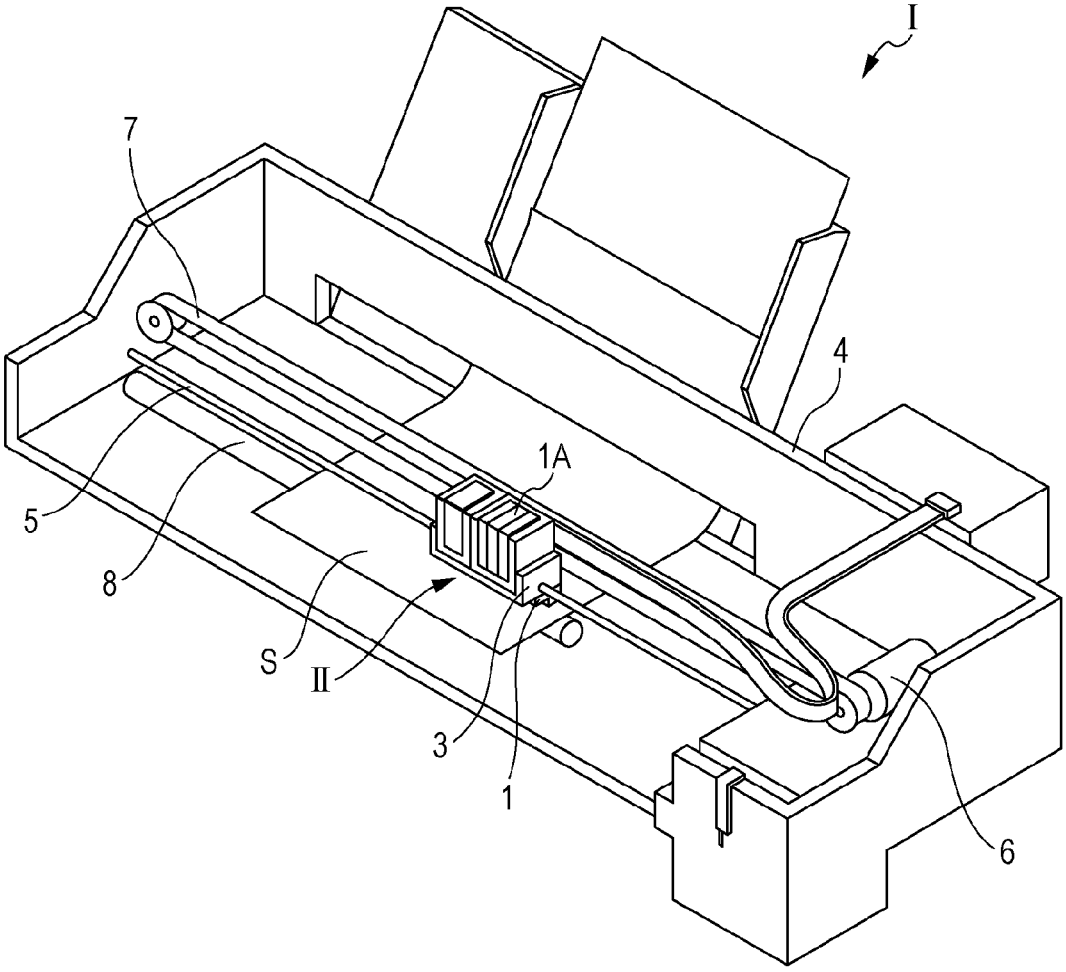
FIG. 15 is a schematic view illustrating an example of an ink jet type recording apparatus.

In addition, the recording head 1 according to one embodiment constitutes or may be included as a part of an ink jet type recording head unit that includes an ink flow path which communicates with an ink cartridge and the like, and may mounted on an ink jet type recording apparatus. FIG. 15 is a schematic view illustrating an example of the ink jet type recording apparatus.

In an ink jet type recording head unit II (hereinafter, referred to the head unit II), which includes a plurality of the recording heads 1, of an ink jet type recording apparatus I illustrated in FIG. 15, a cartridge 1A that constitutes the liquid holding portion is removably disposed. A carriage 3, on which the head unit II is mounted, is disposed on a carriage shaft 5, which is mounted on an apparatus main body 4, to be movable in the axial direction. The head unit II discharges, for example, a black ink composition and a color ink composition.

When the driving force of a drive motor 6 is transmitted to the carriage 3 via a plurality of gears (not illustrated) and a timing belt 7, the carriage 3 on which the head unit II is mounted is moved along the carriage shaft 5. A platen 8 is disposed along the carriage shaft 5 in the apparatus main body 4. A recording sheet S, which is a recording medium such as paper fed by a feed roller (not illustrated), is wound around the platen 8 and transported.

In addition, the ink jet type recording apparatus I in which the recording head 1 (head unit II) is mounted on the carriage 3 and is moved in a main scanning direction has been described above, but embodiments are not limited thereto. For example, embodiments can also be applied to a so-called line type recording apparatus that performs printing by moving the recording sheet S such as paper only in a sub-scanning direction with the recording head 1 fixed thereto.

In addition, the cartridge 1A, which is a liquid holding portion, is configured to be mounted on or in the carriage 3 in the ink jet type recording apparatus I according to the example described above, but embodiments are not limited thereto. For example, the liquid holding portion such as an ink tank may be fixed to the apparatus main body 4 and the liquid holding portion and the recording head 1 may be connected via a supply tube such as a tube. In addition, the liquid holding portion may not be mounted on the ink jet type recording apparatus.

Furthermore, embodiments target a wide range of liquid ejecting heads in general. For example, embodiments can also be applied to or implemented in recording heads such as various types of ink jet type recording heads used in image recording apparatuses such as printers, color material ejecting heads used in manufacturing color filters such as liquid crystal displays, electrode material ejecting heads used in forming electrodes such as organic EL displays and field emission displays (FED), bio-organic material ejecting heads used in manufacturing biochips, and the like.

What is claimed is:

1. A liquid ejecting head comprising:

a head chip that ejects a liquid from a liquid ejecting surface, wherein a liquid connection is disposed on a side of the head chip that is opposite to the liquid ejecting surface so that the supply and discharge of the liquid is performed;

a first flow path member that includes a first flow path for the liquid;

a second flow path member that is bonded to the first flow path member, wherein the second flow path member includes a second flow path for the liquid and an accommodating space that is open to the side opposite to the first flow path member, wherein the accommodating space accommodates the head chip, wherein the second flow path for the liquid is open into the accommodating space and is connected to the first flow path;

a wiring member that is connected to a pressure generating unit which generates a pressure change in a flow path in the head chip; and a wiring substrate that is arranged between the first flow path member and the second flow path member, wherein the liquid connection is connected to the second flow path, wherein a first insertion hole, into which the wiring member is inserted, is disposed in the wiring substrate, wherein a second insertion hole that is open to the accommodating space and the wiring substrate side for the wiring member to be inserted is formed in the second flow path member, and wherein the wiring member is inserted into the first insertion hole and the second insertion hole and is bonded to the first flow path member side of the wiring substrate.

2. The liquid ejecting head according to claim 1, further comprising a seal member that is arranged between the wiring substrate and the first flow path member to connect the first flow path and the second flow path, wherein the seal member includes a protrusion that protrudes to the second flow path member side and a communicating path that is open to a surface of the protrusion facing the second flow path member to penetrate in the direction intersecting with the liquid ejecting surface, wherein a through-hole, into which the protrusion of the seal member is inserted, is disposed in the wiring substrate, and wherein the first flow path and the second flow path communicate with each other via the communicating path that is formed in the protrusion which is inserted into the through-hole.

3. The liquid ejecting head according to claim 2, wherein pressure is applied to at least the protrusion of the seal member by the first flow path member and the second flow path member in a stacking direction in which the first flow path member and the second flow path member are bonded and the protrusion that is formed in the seal member communicates with the communicating path in a sealed state due to the pressure.

4. A liquid ejecting apparatus comprising the liquid ejecting head according to claim 3.

5. A liquid ejecting apparatus comprising the liquid ejecting head according to claim 2.

6. The liquid ejecting head according to claim 1, further comprising a fixing member to which the head chip is fixed and which is fixed to the second flow path member.

7. A liquid ejecting apparatus comprising the liquid ejecting head according to claim 6.

8. The liquid ejecting head according to claim 1, wherein the liquid connection of the head chip protrudes more than any other site of the head chip to the second flow path member side.

9. A liquid ejecting apparatus comprising the liquid ejecting head according to claim 8.

10. The liquid ejecting head according to claim 1, wherein the liquid connection and an opening of the second flow path are bonded with an adhesive.

11. A liquid ejecting apparatus comprising the liquid ejecting head according to claim 10.

12. The liquid ejecting head according to claim 1, wherein a reference mark is formed in the fixing member and the second flow path member so as to define relative positions of the fixing member and the second flow path member.

13. A liquid ejecting apparatus comprising the liquid ejecting head according to claim 12.

14. The liquid ejecting head according to claim 1, wherein a caulking pin is formed on the wiring substrate side of the second flow path member, and wherein the wiring substrate is fixed to the second flow path member as the caulking pin is caulked.

15. A liquid ejecting apparatus comprising the liquid ejecting head according to claim 14.

16. The liquid ejecting head according to claim 1,
wherein the seal member includes:
a plate-shaped base portion where the protrusion and the communicating path are disposed; and
a wall that protrudes from the base portion to the first flow path member side and that is formed to have an annular shape, and
wherein the first flow path member is in contact with at least an outer side of the wall.

17. The liquid ejecting head according to claim 16,
wherein a groove, into which the wall is inserted, is formed on a surface of the first flow path member facing the seal member, and
wherein an opening of the groove into which the wall is inserted is chamfered.

18. A liquid ejecting apparatus comprising the liquid ejecting head according to claim 16.

19. The liquid ejecting head according to claim 1,
wherein a fixing pin is formed in any one of the first flow path member and the second flow path member to protrude to the other side,
wherein a fixing hole, which has an inner surface in contact with a side surface of the fixing pin, is disposed in the other one of the first flow path member and the second flow path member, and
wherein the fixing hole is formed so that an opening on the side where the fixing pin is inserted is larger in outer diameter than the fixing pin.

20. A liquid ejecting apparatus comprising the liquid ejecting head according to claim 1.

* * * * *